US006747614B2

(12) United States Patent
Takayama

(10) Patent No.: US 6,747,614 B2
(45) Date of Patent: Jun. 8, 2004

(54) DRIVING METHOD OF PLASMA DISPLAY PANEL AND DISPLAY DEVICES

(75) Inventor: Kunio Takayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 312 days.

(21) Appl. No.: 09/904,833

(22) Filed: Jul. 16, 2001

(65) Prior Publication Data

US 2002/0130823 A1 Sep. 19, 2002

(30) Foreign Application Priority Data

Mar. 19, 2001 (JP) ..... 2001-077529

(51) Int. Cl.[7] ..... G09G 3/28
(52) U.S. Cl. ..... 345/60; 345/63; 345/66
(58) Field of Search ..... 345/60, 63, 66, 345/68, 208, 210, 72; 315/169.1, 169.4

(56) References Cited

U.S. PATENT DOCUMENTS 5,745,086 A 4/1998 Weber
6,249,087 B1 * 6/2001 Takayama et al.
6,417,822 B1 * 7/2002 Sasaki et al.
6,456,263 B1 * 9/2002 Hashimoto
2002/0118149 A1 8/2002 Tanaka et al.

FOREIGN PATENT DOCUMENTS

| | | |
|---|---|---|
| JP | 11-119728 | 4/1999 |
| JP | 11-184428 | 7/1999 |
| JP | 11-282415 | 10/1999 |
| JP | 2002-258794 | 9/2002 |

* cited by examiner

*Primary Examiner*—Regina Liang
(74) *Attorney, Agent, or Firm*—Staas & Halsey LLP

(57) ABSTRACT

A driving method of a plasma display panel is provided in which background light emission is reduced so that display contrast is improved. The method comprises the steps of resetting for equalizing wall charge in cells constituting a screen, addressing for controlling potentials of address electrodes crossing display electrodes in accordance with display data, and sustaining for applying a sustaining voltage to the cells so as to generate display discharges. The address electrodes are grouped in accordance with discharge characteristics of cells corresponding to each address electrode. In the resetting step, potential control that is unique to each group is performed so that luminance of the discharge light emission in the reset becomes uniform among cells having different discharge characteristics.

13 Claims, 34 Drawing Sheets

DRIVING METHOD OF PLASMA DISPLAY PANEL AND DISPLAY DEVICES

BACKGROUND OF THE INVENTION

1. Field of the Invention

The present invention relates to a driving method of a plasma display panel (PDP).

A PDP is commercialized as a wall-hung television or a monitor of a computer. A PDP is a digital display device having binary light emission cells and is suitable for displaying digital data, which is expected to be used as a multimedia monitor. One of problems to be solved for a PDP is to reduce background luminance.

2. Description of the Prior Art

In an AC type PDP for color display, a three-electrode surface discharge structure is adopted. In this structure, display electrodes to be anodes and cathodes for display discharges are arranged in parallel on the inner side of one of the substrates, and address electrodes are arranged so as to cross the display electrode pairs. Three electrodes work for a cell that is a light emission element unit. In the surface discharge structure, three types of fluorescent material layers for color display are arranged on a second substrate that faces to a first substrate on which the display electrode pairs are arranged, so that deterioration of the fluorescent material layers due to an ion shock upon discharge can be reduced and long life can be obtained. In general, the address electrodes are also arranged on the second substrate and are covered with the fluorescent material layers.

In the PDP display of the surface discharge type, one of the display electrode pair corresponding to a row is used as a scan electrode for row selection. Between the scan electrode and the address electrode, an address discharge is generated, which causes an address discharge between display electrodes, so as to control a charge quantity in a dielectric layer (a wall charge quantity) as addressing. Then, display discharges are generated plural times corresponding to the display luminance as sustaining by using the wall charge. Further, a process (reset) of equalizing an electrification state of the entire screen is performed prior to the addressing. When the sustaining finishes, there are cells with remaining relatively much wall charge and cells with remaining little wall charge. Therefore, the reset process is performed as an addressing preparation process for enhancing reliability of the display.

In the U.S. Pat. No. 5,745,086, the reset process is disclosed, in which a first ramp voltage and a second ramp voltage are applied to cells sequentially. When applying the ramp voltage having a small gradient, in accordance with characteristics of a micro discharge that will be explained below, light quantity of a light emission in the reset period is decreased for preventing a contrast drop, and the wall voltage can be set to any target value regardless of variation of the cell structure.

When a ramp voltage with increasing amplitude is applied to a cell having an appropriate quantity of wall charge, plural micro discharges occur while the applied voltage increases if the ramp voltage has a small gradient. If the gradient is smaller than this, a continuous discharge occurs with short discharge period. In the following explanation, both the periodical discharge and the continuous discharge are called "micro discharge". In the period generating the micro discharge, even if a cell voltage (=wall voltage+applied voltage) exceeds a discharge start threshold level due to increase of the ramp voltage, the cell voltage is always kept at the vicinity of the discharge start threshold level. It is because that the micro discharge drops the wall voltage by equivalent to the increase of the ramp voltage. Since the discharge start threshold level is a constant value determined by electric characteristics of a cell, the wall voltage can be set to any value that is suitable for the addressing by setting the final value of the ramp voltage. Namely, even if there is a minute difference of the discharge start threshold level between cells, a relative difference between the discharge start threshold level and the wall voltage can be equalized in all cells.

In the reset process utilizing the characteristics of the micro discharge, the first ramp voltage is applied so as to form an appropriate quantity of wall charge in the cell, and then the second ramp voltage is applied so that the wall voltage between the electrodes becomes close to the target value. The amplitude of the first ramp voltage is set so that the micro discharge is always generated by the second ramp voltage. In addition, the polarity of the second ramp voltage is set to be the same as that of the voltage that is applied in addressing.

Conventionally, control of the electrode potential in the reset process is uniform in all cells.

However, it was a problem in the reset by the conventional driving method that reduction of a background light emission is difficult. The background light emission is a light emission in an area of the screen that is not to be lighted. Another problem is that the background light emission can gain a color, resulting in a deterioration of gradations in color. Causes of these problems will be described below.

FIG. 34A shows three voltage waveforms (the applied voltage, the wall voltage and the cell voltage) between YA electrodes in the conventional reset process. FIG. 34B shows a transition of an integral light emission quantity in a reset period TR. The language "between YA electrodes" means between the scan electrode and the address electrode, and the language "integral light emission quantity" means a sum of the light emission quantity in the case where an optional period is paid attention. In the example shown in FIGS. 34A and 34B, the wall voltage just before the reset process is a constant value regardless of the fluorescent material. Characteristics of red, green and blue fluorescent materials are indicated with a broken line, a full line and a chain line, respectively.

Three types (red, green and blue) of fluorescent materials are used for color display. Usually, these fluorescent materials have different properties, particle diameters and surface states of layers. This means that the discharge characteristics of the cell can be affected not only by the variation of the cell structure due to a production process but also by difference in type of the fluorescent material. The difference of the discharge start threshold level between cells of different fluorescent material types can be 50 volts or more.

Here, the case where the discharge start threshold level between YA electrodes is unique to each light emission color of the fluorescent material will be explained. When the address electrodes are the cathodes, the discharge start threshold levels of red, green and blue colors between YA electrodes are denoted as $Vt_{YA}(R)$, $Vt_{YA}(G)$ and $Vt_{YA}(B)$. It is supposed that the following relationship is satisfied.

$$Vt_{YA}(R)<Vt_{YA}(B)<Vt_{YA}(G) \quad (1)$$

Then, as shown in FIG. 34A, discharges are generated in different time points for each light emission color. When the address electrodes are the anodes, the discharge start threshold level $Vt_{AY}$ between YA electrodes is regarded as a constant value regardless of the fluorescent material. Since the discharge start threshold level depends mainly on a secondary electron emission coefficient of dielectric in the cathode side, the above assumption is practical. However, this argument can be easily applied also to the case where the discharge start threshold level $Vt_{AY}$ depends on the fluorescent material.

When the first ramp voltage (a write pulse) is applied, the micro discharge starts in the order of red, blue and green in accordance with the relationship (1). Therefore, the light emission period is the longest in red cells, second longest in blue cells, and the shortest in green cells. In addition, the variations of the wall charge in red, green and blue cells are different from each other, so the wall voltage values are different between red, green and blue cells when the application of the first ramp voltage finishes. Therefore, the micro discharge starts in the order of red, blue and green colors also when the second ramp voltage (a compensating discharge pulse) is applied, so that the light emission period is longer in the order of red, blue and green.

The amplitudes $V1_{YA}$ and $V2_{YA}$ of the ramp waveform are set so that a discharge is generated securely in green cells, which are hardest to generate a discharge among three colors. Therefore, light emission quantities of red and blue colors are naturally larger than that of green color, so that luminance of the background light emission increases. Furthermore, since a valance among red, green and blue colors is lost, the background light emission color is not a white color with small luminosity (a dark gray color) but a reddish color. It can be a bluish color depending on a selection of the fluorescent material.

SUMMARY OF THE INVENTION

An object of the present invention is to reduce the background light emission so that contrast of display can be improved.

In the present invention, address electrodes are grouped in accordance with discharge characteristics of cells corresponding to each of the address electrode, and potential control is performed, which is unique to each group so that luminance of the discharge light emission in a reset becomes uniform among cells having different discharge characteristics in the reset that is preparation for addressing. In other words, discharge intensities and light emission periods of other cells are optimized so that the luminance is adapted to that of the cell having the lowest luminance, by controlling potential for each group.

A typical example of grouping is to group in accordance with a type of the fluorescent material. If the discharge characteristics are different among three cells having different fluorescent materials, the address electrodes are divided into three groups. If one type is different from the other two types concerning the discharge characteristics, the address electrodes are divided into two groups. If the discharge characteristics are different depending on a position in the screen, two or more groups are made.

DESCRIPTION OF THE PREFERRED EMBODIMENTS

Hereinafter, the present invention will be explained more in detail with reference to embodiments and drawings.

Figure 1:
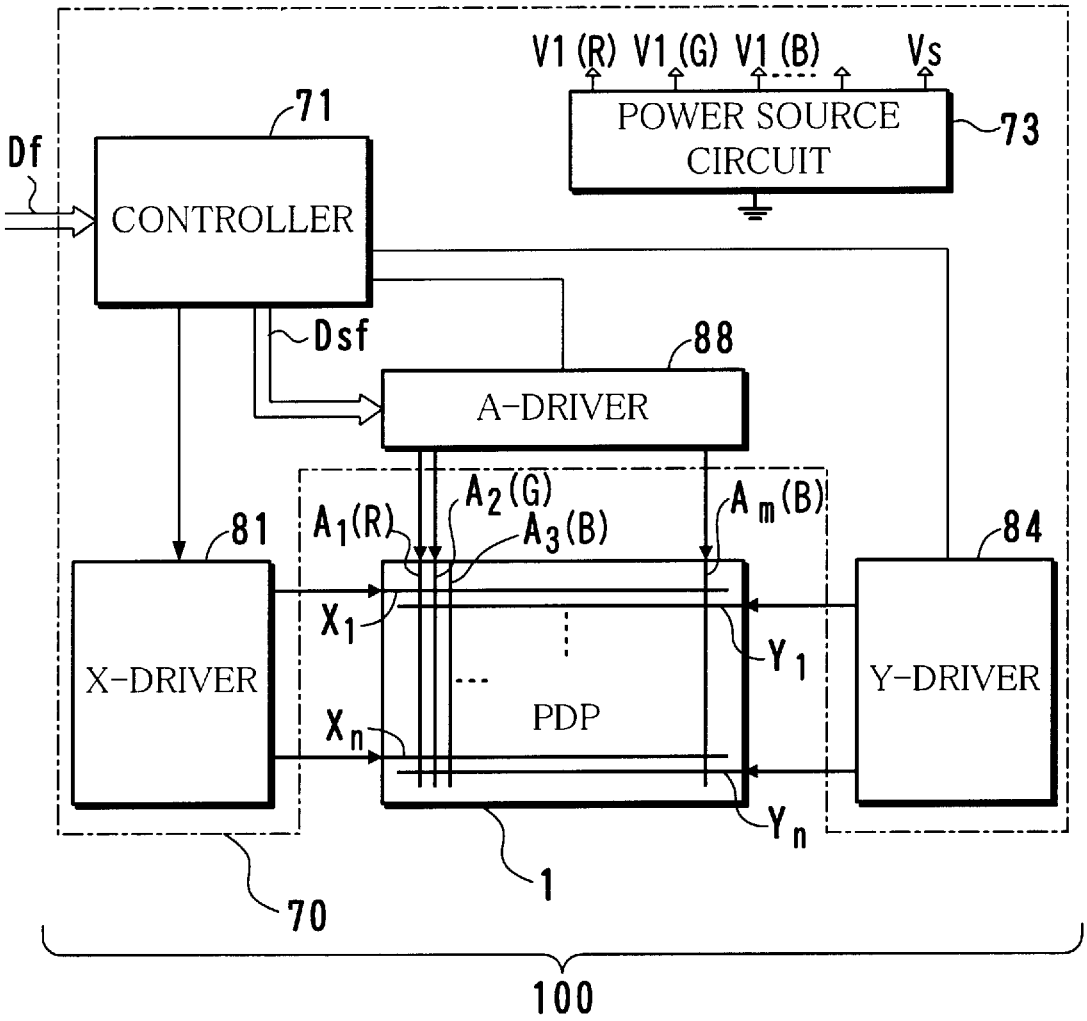
FIG. 1 is a block diagram of a display device according to the present invention.

FIG. 1 is a block diagram of a display device according to the present invention. The display device 100 comprises a surface discharge type PDP 1 having a screen made of m×n cells and a drive unit 70 for controlling light emission of cells. The display device 100 is used as a wall-hung television or a monitor of a computer system.

The PDP 1 has display electrodes X and Y arranged in parallel to make electrode pairs for generating display discharges and address electrodes A arranged so as to cross the display electrodes X and Y. The display electrodes X and Y extend in the row direction of the screen (in the horizontal direction), while the address electrodes extend in the column direction (in the vertical direction). The display electrode Y is used as a scan electrode, while the address electrode A is used as a data electrode. In FIG. 1, suffixes (1, n) of reference letters of the display electrodes X and Y indicate an arrangement order of the corresponding row, while suffixes (1-m) of reference letters of the address electrode A indicate an arrangement order of the corresponding column. The row is a set of m (the number of columns) cells having the same arrangement order in the column direction, while the column is a set of n (the number of rows) cells having the same arrangement order in the row direction. Furthermore, each of letters R, G and B in parenthesis indicates light emission color of the cell corresponding to the element accompanied by the letter.

The drive unit 70 includes a controller 71, a power source circuit 73, an X-driver 81, a Y-driver 84 and an A-driver 88. The drive unit 70 is supplied with frame data Df indicating luminance levels of red, green and blue colors along with various synchronizing signals from external equipment such as a TV tuner or a computer. The frame data Df are temporarily stored in a frame memory of the controller 71. The controller 71 converts the frame data Df into subframe data Dsf for gradation display and sends them to the A-driver 88. The subframe data Dsf are a set of display data including a bit per cell. The value of the each bit indicates whether the cell is lighted or not in the corresponding subframe, more specifically whether an address discharge is required or not. In the case of interlace display, each field of a frame includes plural subfields, so that the light emission control is performed for each subfield. However, contents of the light emission control are the same as that in progressive display.

Figure 2:
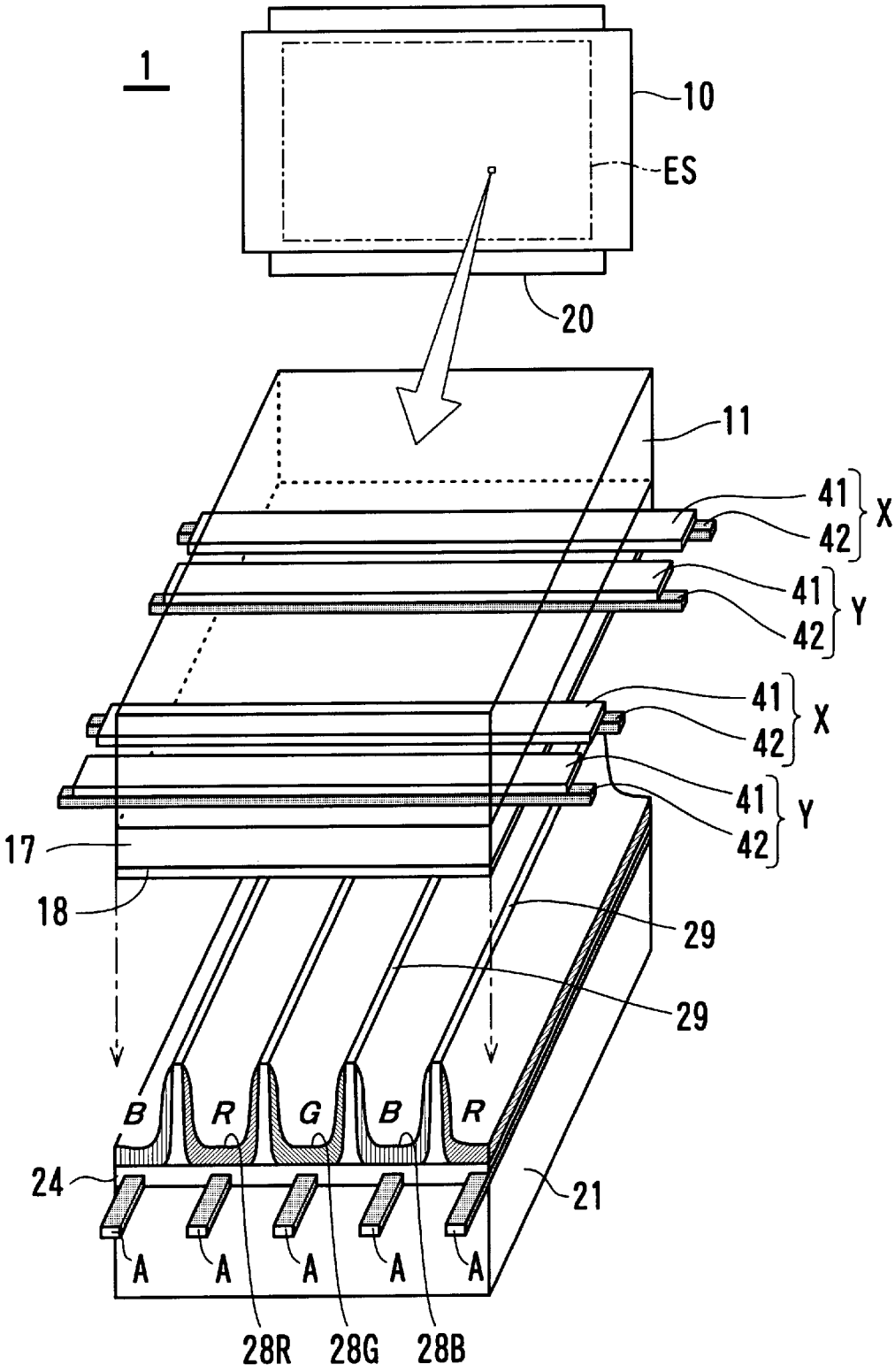
FIG. 2 shows an example of a cell structure of a PDP.

FIG. 2 shows an example of a cell structure of a PDP.

The PDP 1 has a pair of substrate structures (structures of substrates on which cell elements are arranged) 10 and 20. On the inner surface of a front glass substrate 11, the display electrodes X and Y are arranged so that a pair of display electrodes X and Y corresponds to each row of an n×m screen ES. The display electrodes X and Y include a transparent conductive film 41 that forms a surface discharge gap and a metal film 42 that is overlaid on the edge portion of the transparent conductive film 41. The display electrodes X and Y are covered with a dielectric layer 17 and a protection film 18. On the inner surface of a back glass substrate 21, address electrodes A are arranged so that one address electrode A corresponds to a column. The address electrodes A are covered with a dielectric layer 24. On the dielectric layer 24, a partition 29 is formed for dividing a discharge space into columns. The surface of the dielectric layer 24 and the side face of the partition 29 are covered with fluorescent material layers 28R, 28G and 28B for color display. A discharge gas emits ultraviolet rays, which excite the fluorescent material layers 28R, 28G and 28B locally to emit light. Italic letters (R, G and B) in FIG. 2 indicate light emission colors of the fluorescent materials. The color arrangement has a repeated pattern of red, green and blue colors in which cells in a column have the same color. For example, the red fluorescent material is $(Y,Gd)BO_3:Eu^{3+}$, the green fluorescent material is $Zn_2SiO_4:Mn$, $BaAl_{12}O_{19}:Mn$, and the blue fluorescent material is $BaMgAl_{10}O_{17}:Eu^{2+}$.

Hereinafter, a driving method of the PDP 1 of the display device 100 will be explained.

Figure 3:
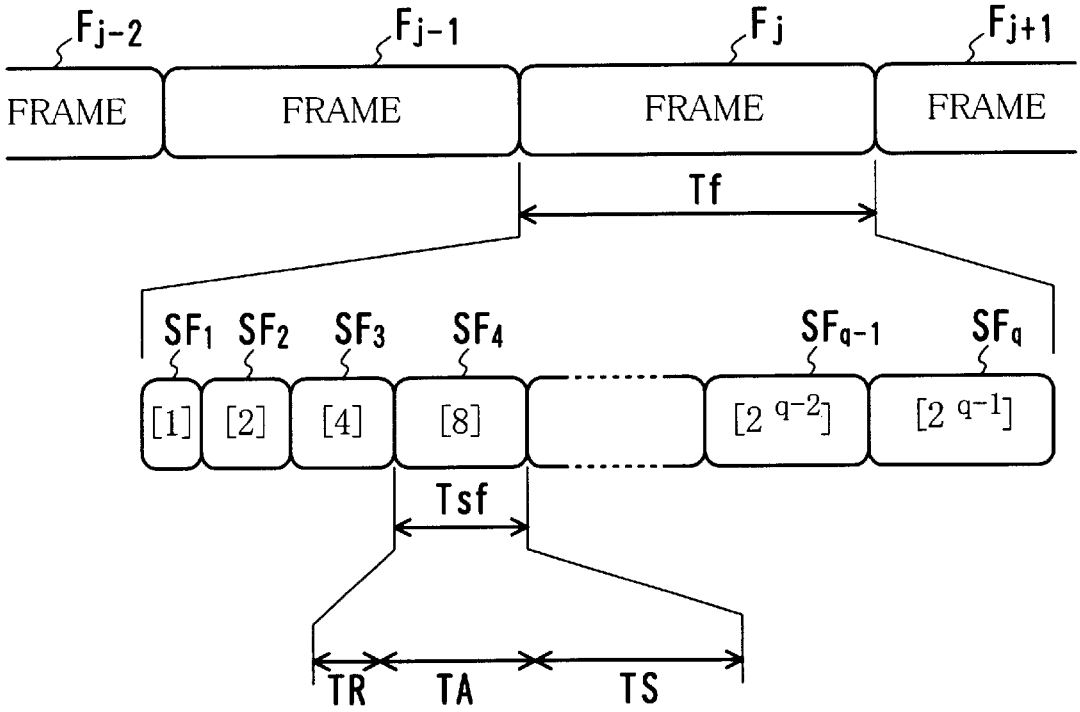
FIG. 3 shows a concept of frame division.

FIG. 3 shows a concept of frame division. In order to reproduce colors by binary light control in the PDP 1, a frame F of a sequential input image is divided into a predetermined number (q) of subframes SF. Namely, each frame F is replaced with a set of q subframes SF. Weights $2^0$, $2^1$, $2^2$, . . . , $2^{q-1}$ are given to the subframes SF sequentially so as to set the number of display discharge times in each of the subframes SF. N $(=1+2^1+2^2+\ldots+2^q)$ steps of luminance levels can be set for each of red, green and blue colors by combining on and off in each subframe. Though the subframes are arranged in the weight order in FIG. 2, other arrangement order can be adopted. Redundant weighting can be adopted for reducing ghost images. In accordance with this frame structure, a frame period (frame transmission period) Tf is divided into q subframe periods Tsf, and, one subframe period Tsf is assigned to each of the subframes SF. In addition, the subframe period Tsf is divided into a reset period TR for initialization, an address period TA for addressing and a display period TS for sustaining. The lengths of the reset period TR and the address period TA are constant regardless of the weight, while the length of the display period TS is longer as the weight is larger. Therefore, the length of the subframe period Tsf is also longer as the weight of the corresponding subframe SF is larger. Driving sequence is repeated for each subframe, and the order of the reset period TR, the address period TA and the display period TS is common in the q subframes SF.

[First Embodiment]

Figure 4:
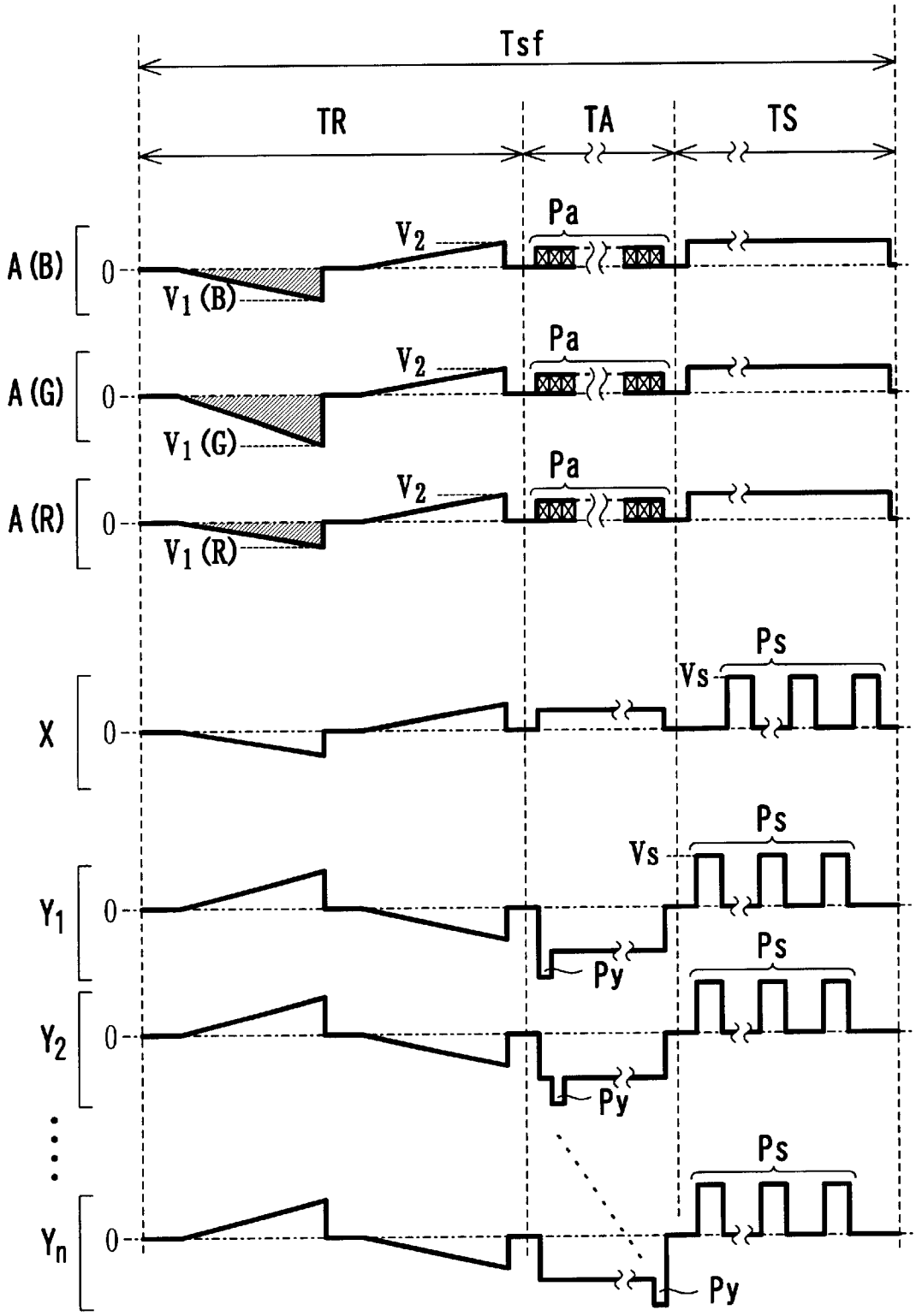
FIG. 4 is a diagram showing waveforms of applied voltage in a first embodiment.

FIG. 4 is a diagram showing waveforms of applied voltage in the first embodiment. First, schematic driving sequence will be explained, and after that, detail of the reset relating to the present invention will be explained.

In the reset period TR, a write pulse and a compensating discharge pulse are applied to the address electrode A, the display electrode X and the display electrode Y, so that a ramp waveform voltage is applied twice between YA electrodes and between display electrodes (hereinafter, referred to as "between XY electrodes") of each cell. The first application generates an appropriate wall voltage of the same polarity in all cells regardless of whether the cell was lighted or not in the previous subframe. The second application adjusts the wall voltage of the cell to a value corresponding to the difference between the discharge start threshold level and the applied voltage. A voltage pulse can be applied only to one of the display electrodes X and Y and the address electrode. However, if voltage pulses having opposite polarities are applied to both electrodes between electrodes as shown in FIG. 4, withstand voltage of driver circuit elements can be lowered. The applied voltage between electrodes is a composed voltage in which amplitudes of pulses to be applied to each electrode are added. The application of a pulse means to bias an electrode temporarily. In FIG. 4, a bias reference is the ground potential.

In the address period TA, wall charge necessary for sustaining is formed only in cells to be lighted. All the display electrodes X and all the display electrodes Y are biased to a predetermined potential, while a scan pulse Py of the negative polarity is applied to the display electrode Y corresponding to the selected row in every row selection period (a scan time for a row). At the same time as this row selection, an address pulse Pa is applied only to the address electrodes A corresponding to the selected cells that are to generate the address discharge. In other words, the potentials of the address electrodes $A_1$–$A_m$ are controlled by binary value in accordance with the subframe data Dsf of m columns in the selected row. In the selected cell, a discharge between the display electrode Y and the address electrode A is generated, and the discharge causes a surface discharge between the display electrodes. These sequential discharges constitute an address discharge.

In the display period TS, a sustaining pulse Ps of a predetermined polarity (the positive polarity in the example) is applied to all the display electrodes Y first. After that, a sustaining pulse Ps is applied alternately to the display electrode X and the display electrode Y. The amplitude of the sustaining pulse Ps is a sustaining voltage (Vs). The application of the sustaining pulse Ps generates the surface discharge in cells where a predetermined quantity of wall charge remains. The number of application times of the sustaining pulse Ps corresponds to the weight of the subframe as explained above. The address electrode A is biased to the same polarity as the sustaining pulse Ps over the whole sustaining period TS for preventing undesired discharge.

Figure 5:
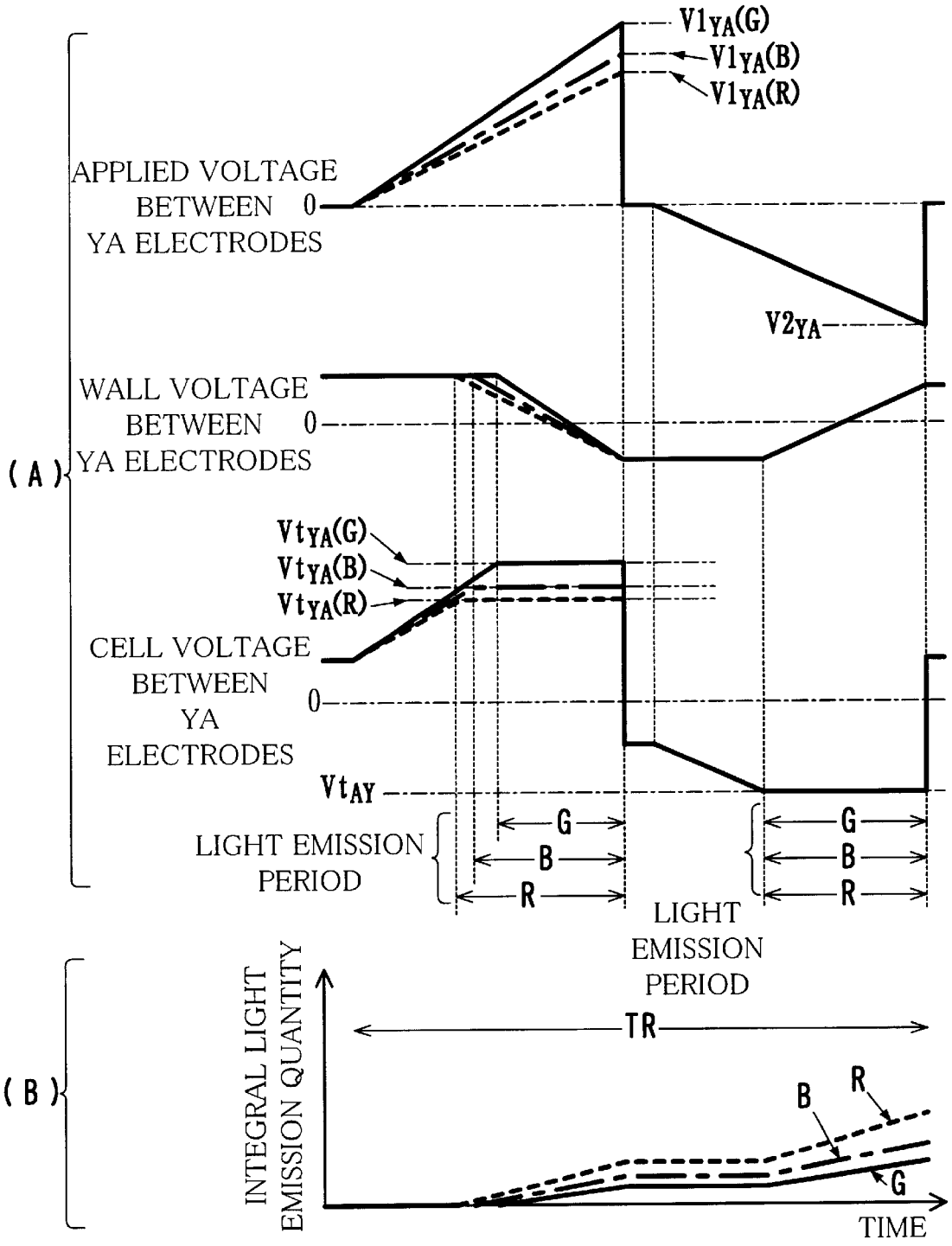
FIG. 5 is a diagram showing voltage waveforms and a transition of an integral light emission quantity in a reset process of the first embodiment.
Figure 6:
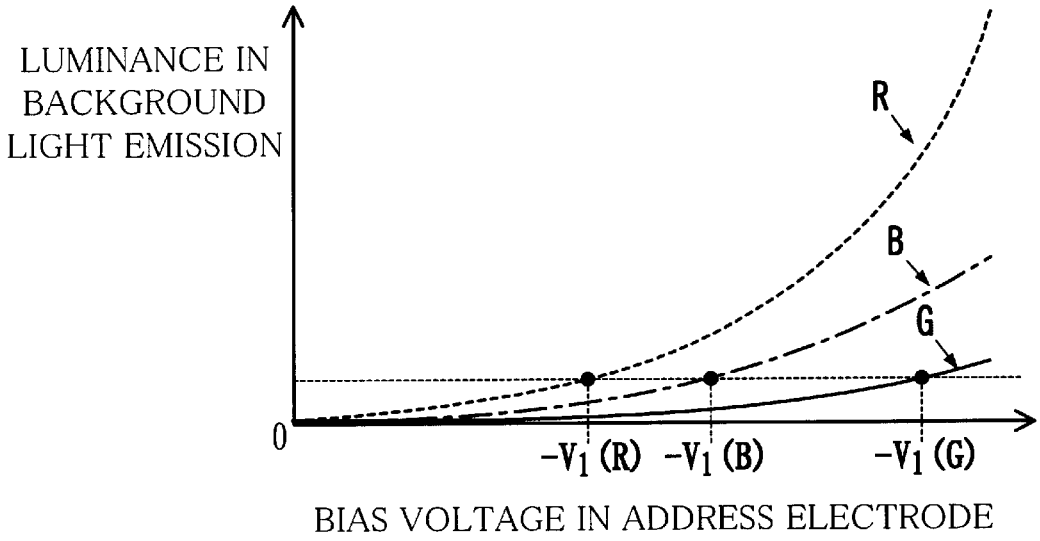
FIG. 6 is a graph showing a concept of voltage setting in the first embodiment.

FIG. 5 is a diagram showing voltage waveforms and a transition of an integral light emission quantity in a reset process of the first embodiment. FIG. 6 is a graph showing a concept of voltage setting in a reset process of the first embodiment.

In the first embodiment, the amplitudes $V_1(R)$, $V_1(G)$ and $V_1(B)$ of pulses that are applied to the address electrode A in the reset period TR are set for each type (red, green or blue) of the fluorescent material. For example, if the relationship (1) is satisfied in the same way as in the conventional method explained above, the peak values of the write pulses (voltage values including polarities as application conditions) $V_1(R)$, $V_1(G)$ and $V_1(B)$ are set so as to satisfy the following relationship (2). The amplitude of the compensating discharge pulse is set to a value $V_2$ that is common to all the address electrodes A regardless of the type of the fluorescent material.

$$V_1(G)<V_1(B)<V_1(R) \quad (2)$$

By applying the write pulse to both the address electrode A and the display electrode Y, ramp voltages having final values $V1_{YA}(R)$, $V1_{YA}(B)$ and $V1_{YA}(G)$ are applied between YA electrodes in cells of red, green and blue colors as shown in FIG. 5. On this occasion, the micro discharge starts in the order of red, blue and green colors in the same way as in the conventional method. However, since the gradient of the ramp waveform is different, there is not a large difference in quantity of charge transfer among red, blue and green colors in the write period. In other words, when the application of the write pulse finishes, the wall voltage values become substantially equal to each other regardless of the type of the fluorescent material. Therefore, when the compensating discharge pulse is applied, the micro discharge starts at substantially the same time in red, blue and green cells regardless of the type of the fluorescent material, and the light emission period becomes uniform among three colors. In order to reduce the background luminance, the amplitudes $V_1(R)$ and $V_1(B)$ of red and blue colors are set so that substantially the same luminance as that of the green color having the lowest luminance can be obtained noting the light emission characteristics shown in FIG. 6.

According to the first embodiment, even if the discharge characteristics of the cell are unique to the light emission color of the fluorescent material, the background light emission can be freely controlled. In addition, since the discharge light emission quantity does not increases also in cells having a low discharge start threshold level, the luminance of the background light emission can be controlled at a low level, resulting in an improvement of contrast.

FIGS. 7–17 show waveforms of the applied voltages in other examples of the first embodiment.

Figure 7:
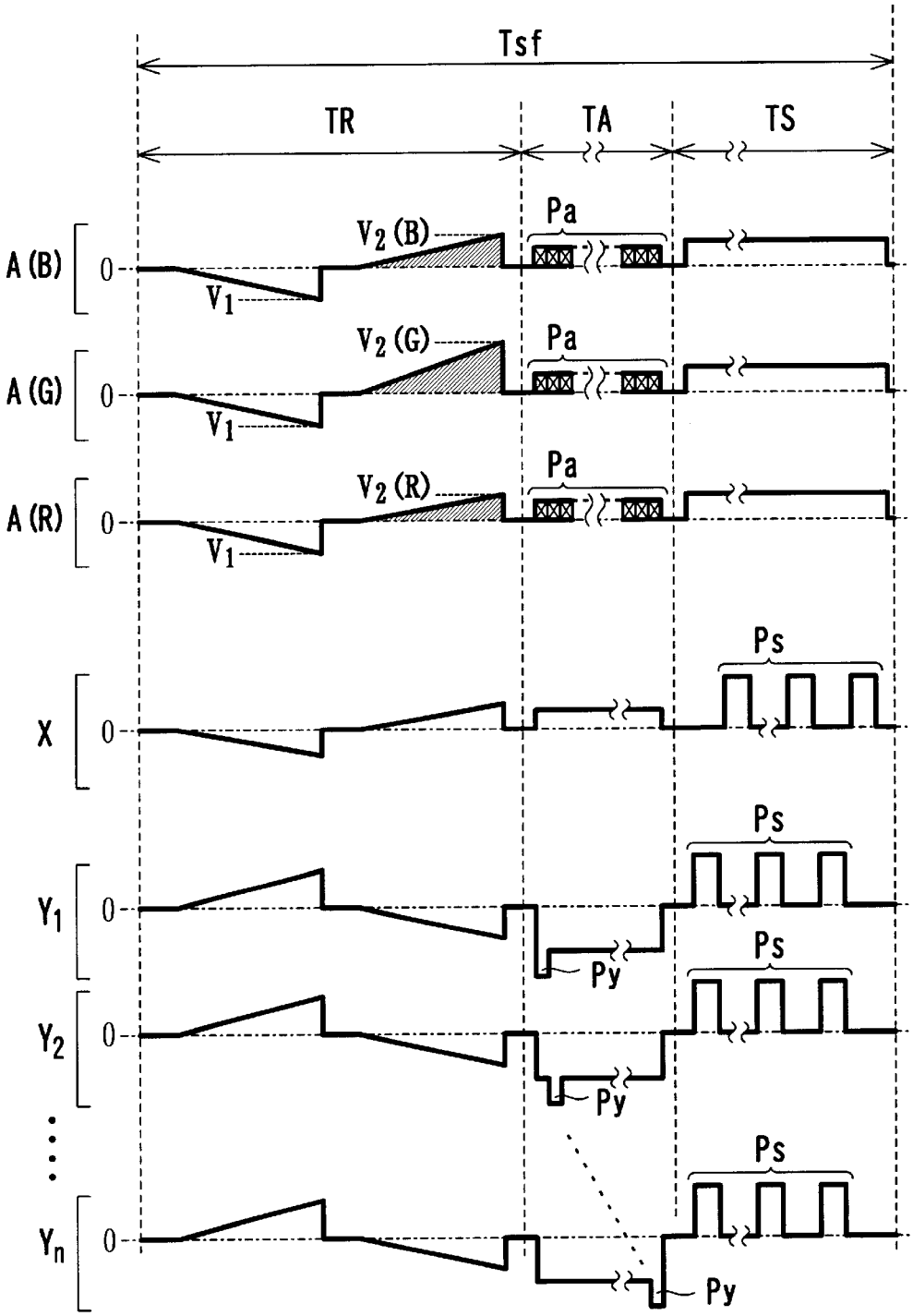
FIGS. 7–17 show waveforms of the applied voltages in other examples of the first embodiment.
Figure 8:
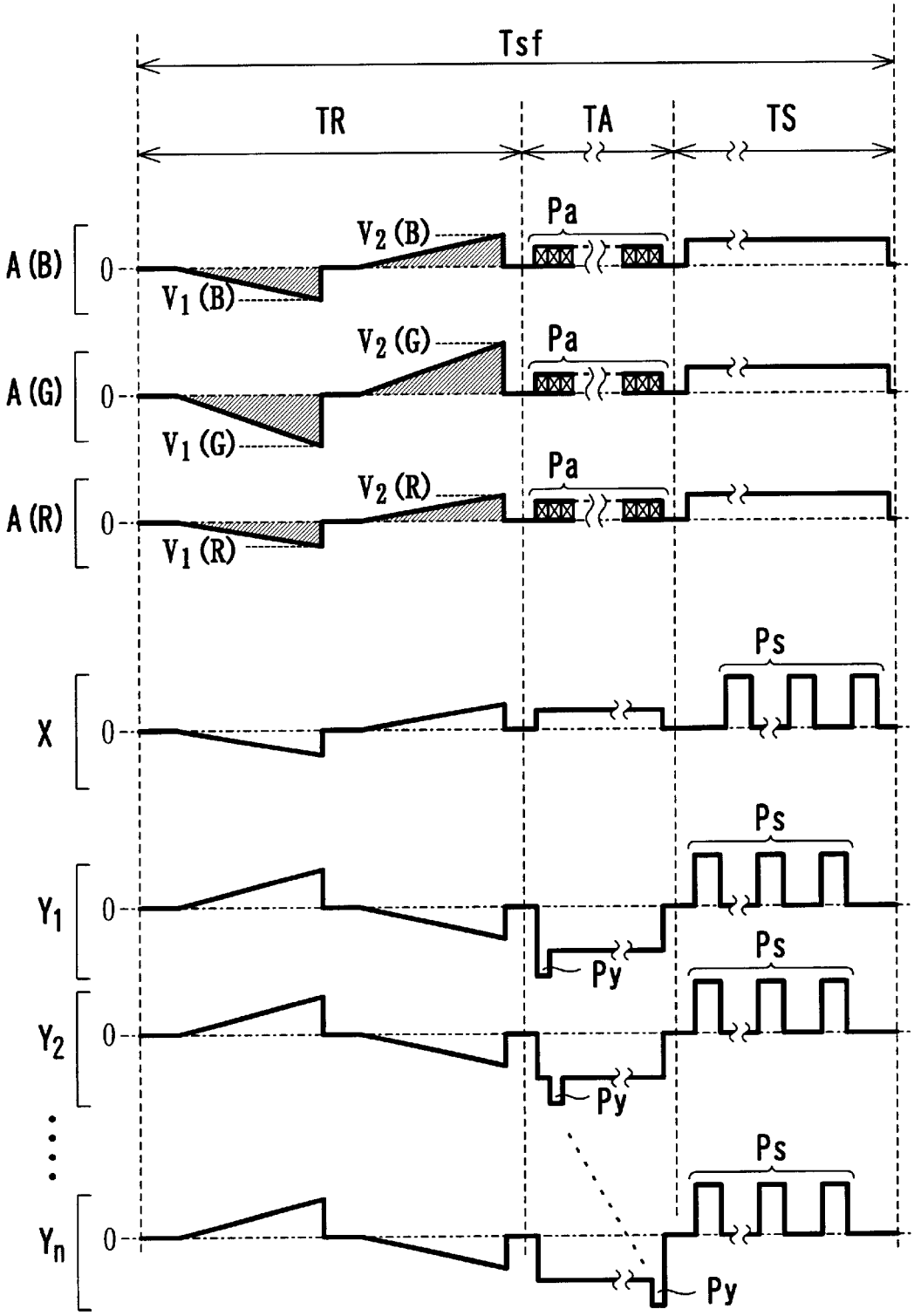

In FIG. 7, amplitudes $V_2(R)$, $V_2(G)$ and $V_2(B)$ of the compensating discharge pulses that are applied to the address electrode A are set for each type of the fluorescent material. The amplitude $V_1$ of the write pulse is common. In FIG. 8, both amplitudes of the write pulse and the compensating discharge pulse are set for each type of the fluorescent material.

Figure 9:
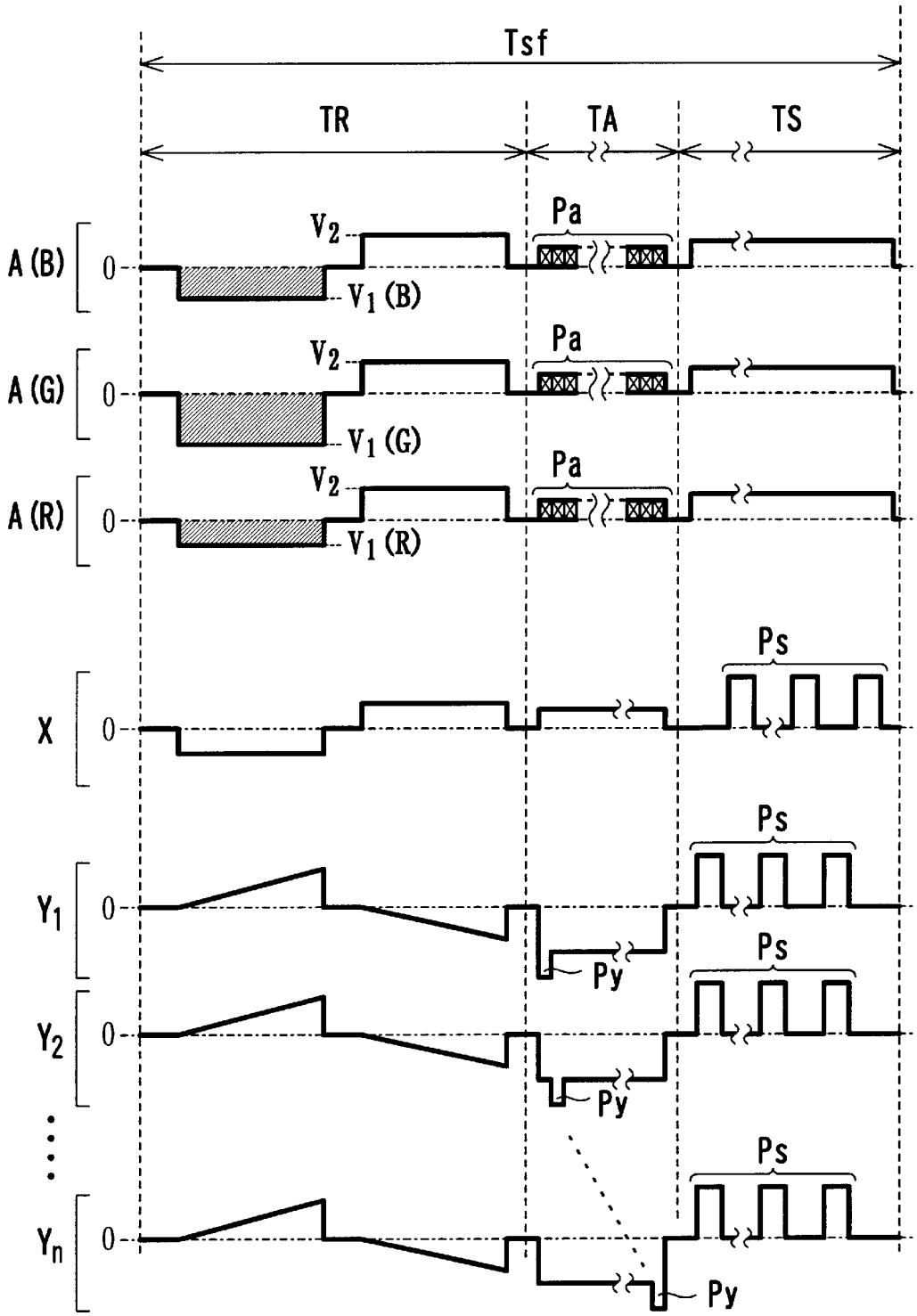
Figure 10:
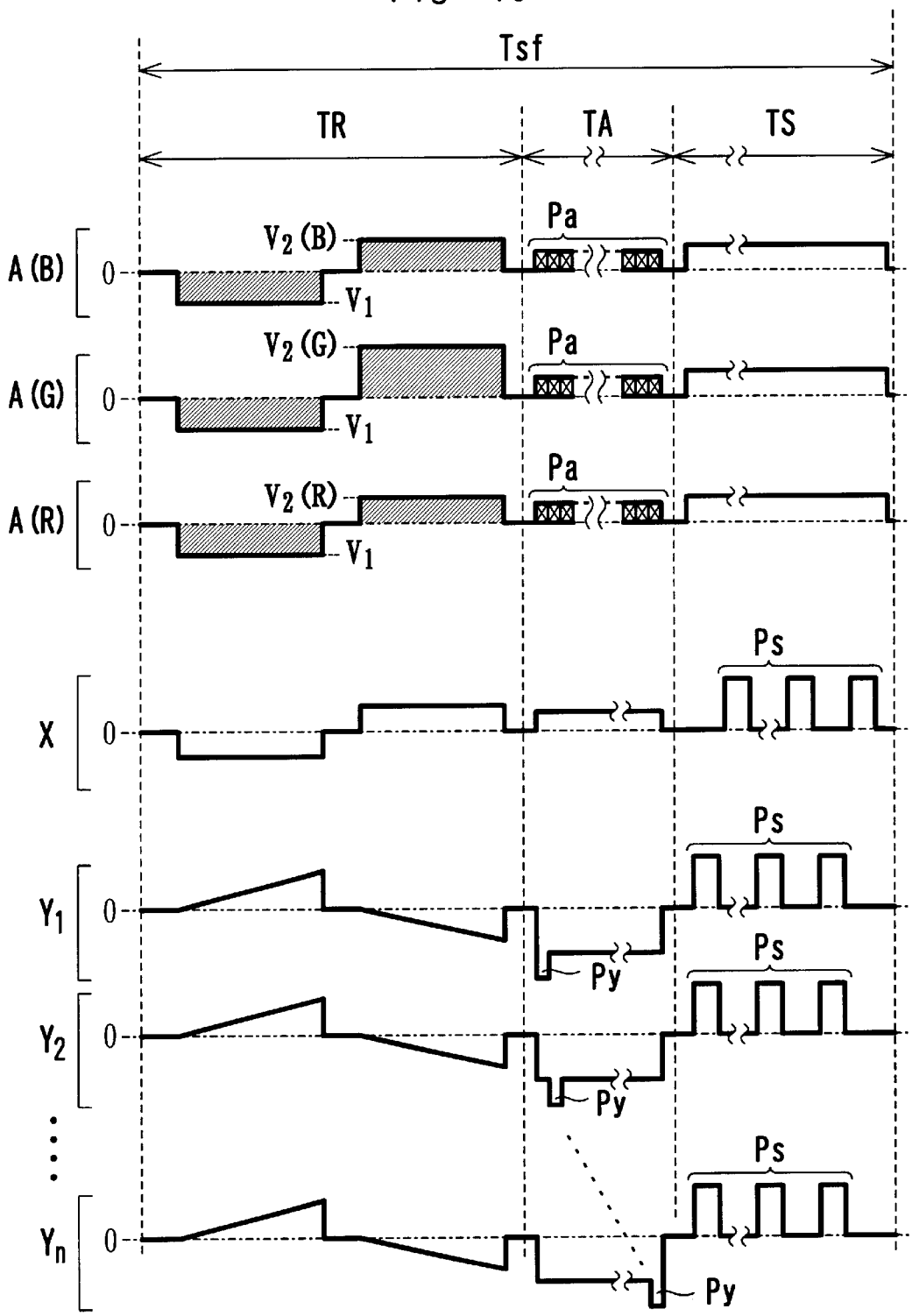
Figure 11:
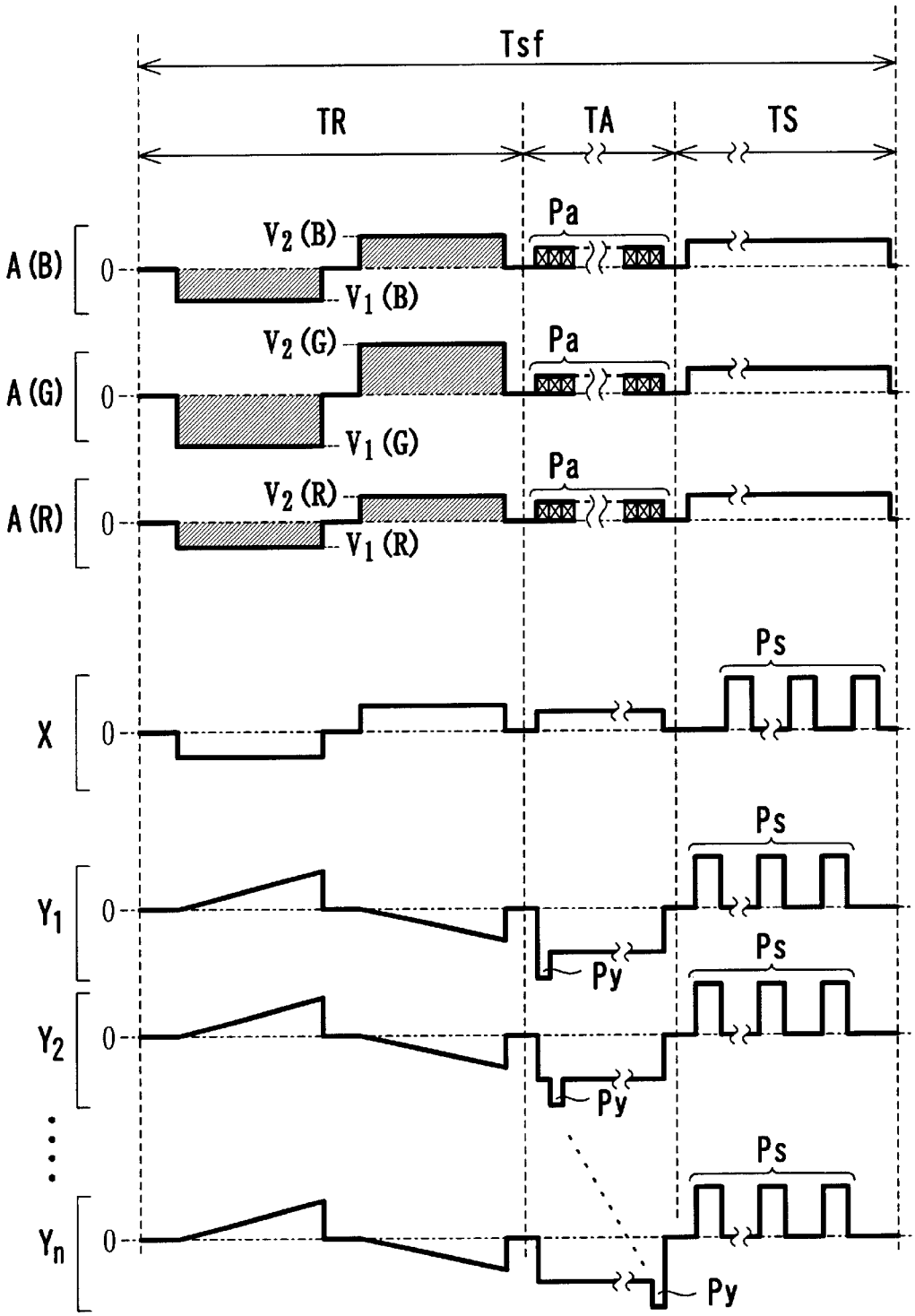
Figure 12:
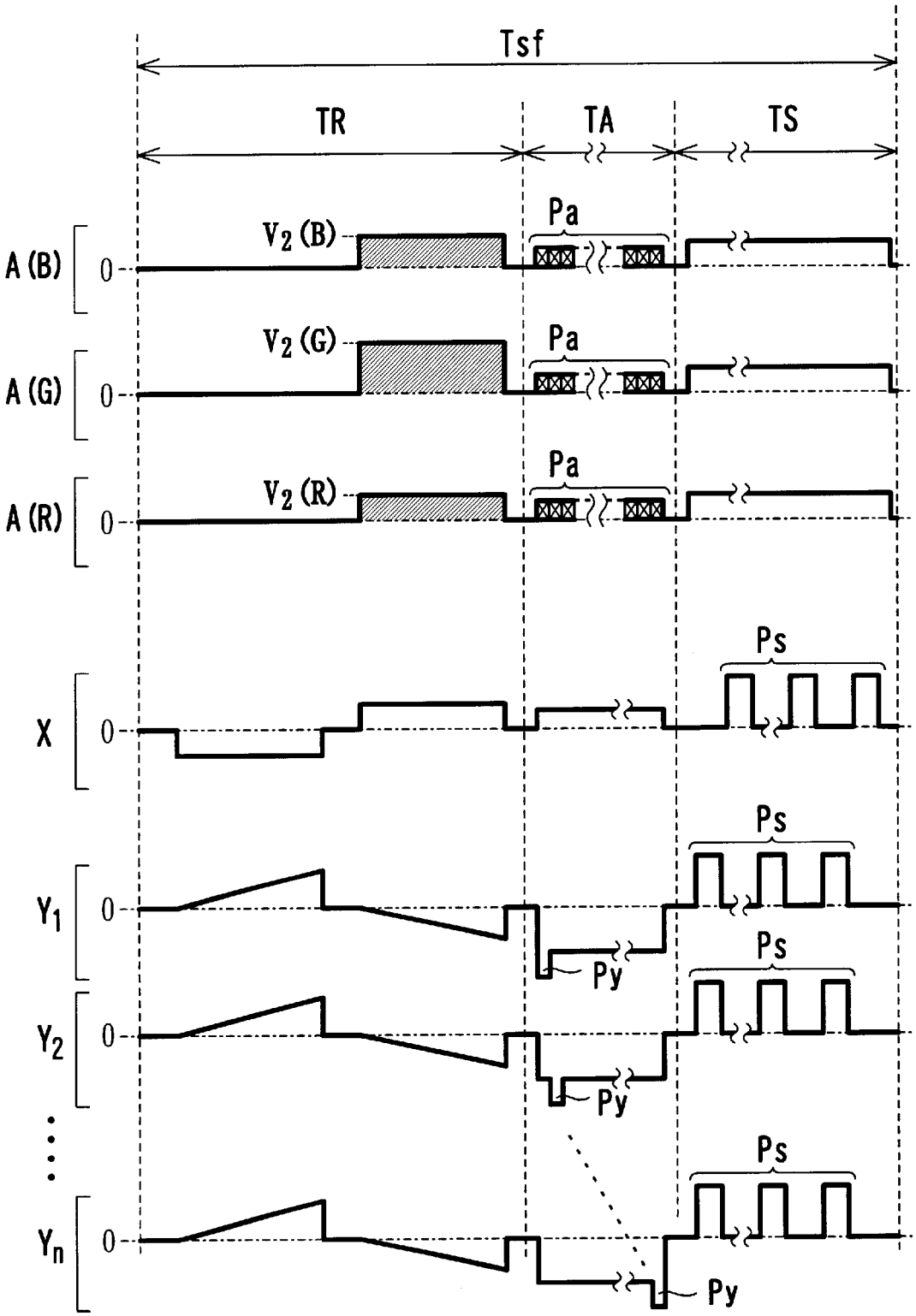
Figure 13:
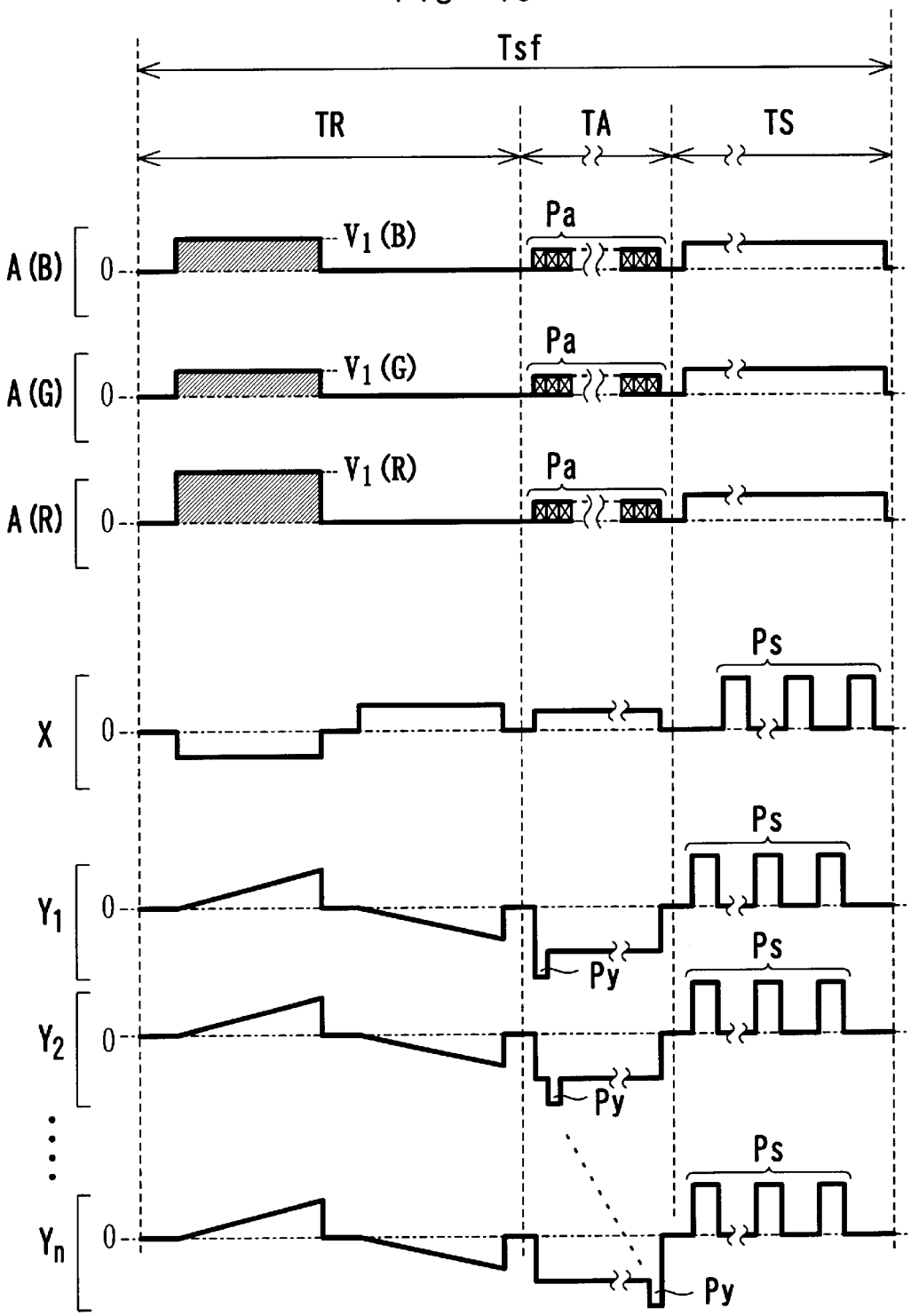
Figure 14:
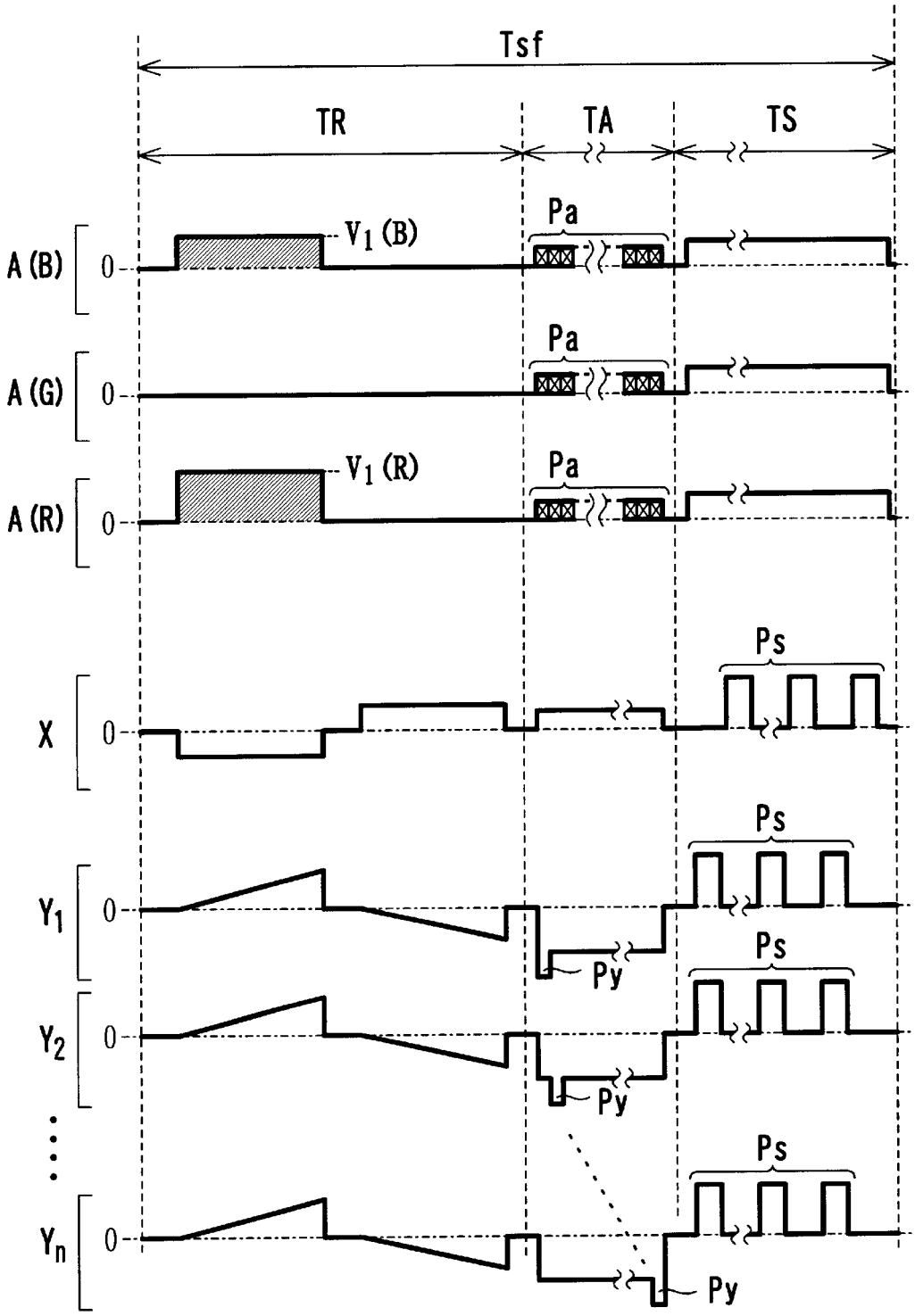

In FIGS. 9–17, only the write pulse and the compensating discharge pulse that are applied to the display electrode Y are the ramp waveform pulses, while the write pulse and the compensating discharge pulse that are applied to the address electrode A and the display electrode X are rectangular pulses. In FIG. 9, amplitudes $V_1(R)$, $V_1(G)$ and $V_1(B)$ of the write pulses that are applied to the address electrode A are set for each type of the fluorescent material. In FIG. 10, amplitudes $V_2(R)$, $V_2(G)$ and $V_2(B)$ of the compensating discharge pulses that are applied to the address electrode A are set for each type of the fluorescent material. In FIG. 11, amplitudes $V_1(R)$, $V_1(G)$ and $V_1(B)$ and amplitudes $V_2(R)$, $V_2(G)$ and $V_2(B)$ are set for each type of the fluorescent material. In FIG. 12, the write pulse is not applied to the address electrode A, while the compensating discharge pulse whose amplitude is set for each type of the fluorescent material is applied. In FIG. 13, the write pulse whose amplitude is set for each type of the fluorescent material is applied to the address electrode A, while the compensating discharge pulse is not applied. In FIG. 14, an amplitude of the write pulse that is applied to the address electrode A corresponding to the green cell is set to zero.

Figure 15:
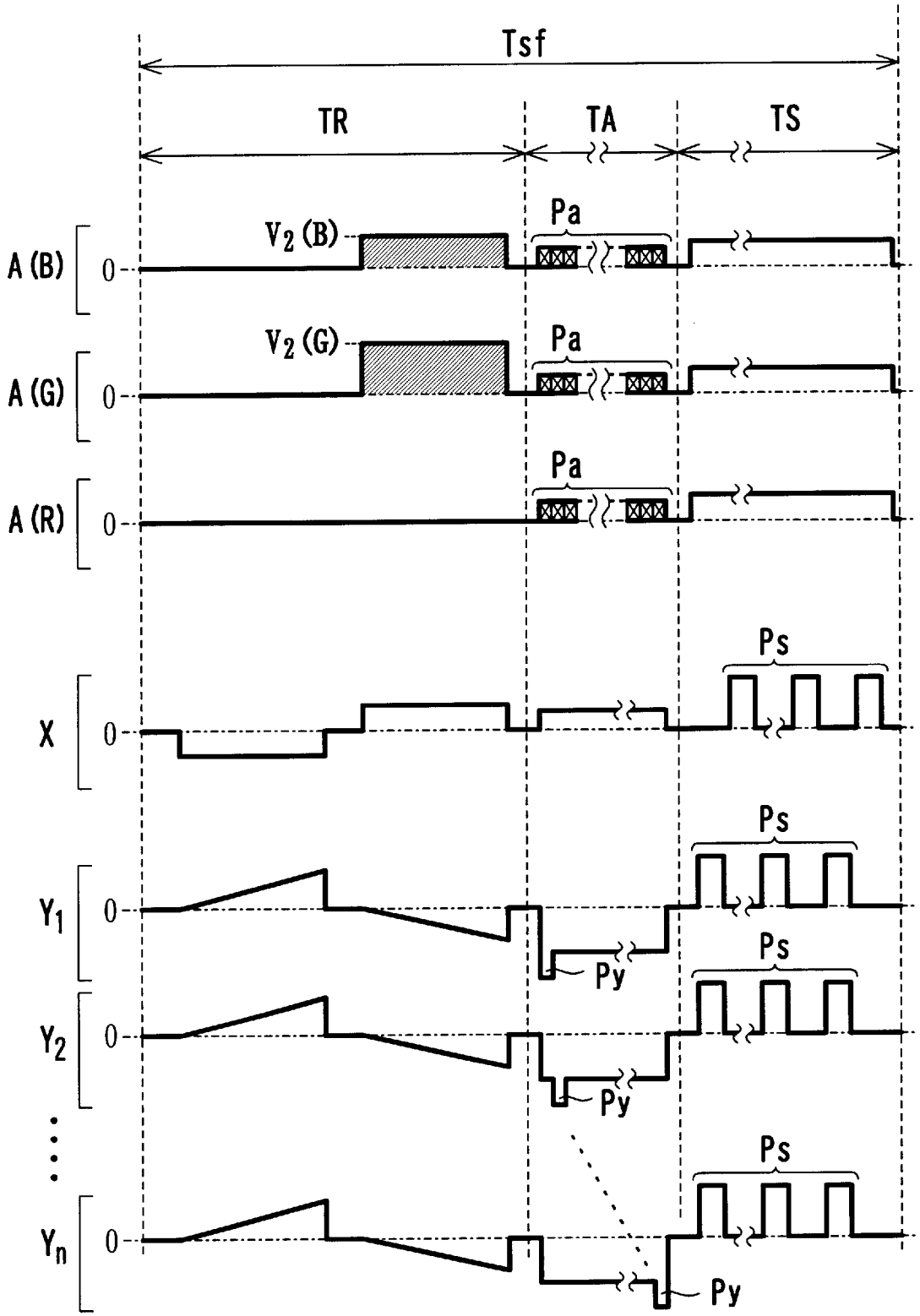

If the relationship of the discharge start threshold levels does not satisfy the relationship (1), it is necessary to set amplitudes in accordance with the relationship. In FIG. 15, amplitudes of the compensating discharge pulses that are applied to the address electrode A satisfy the following relationship (3).

$$V_2(R)<V_2(B)<V_2(G) \quad (3)$$

Figure 16:
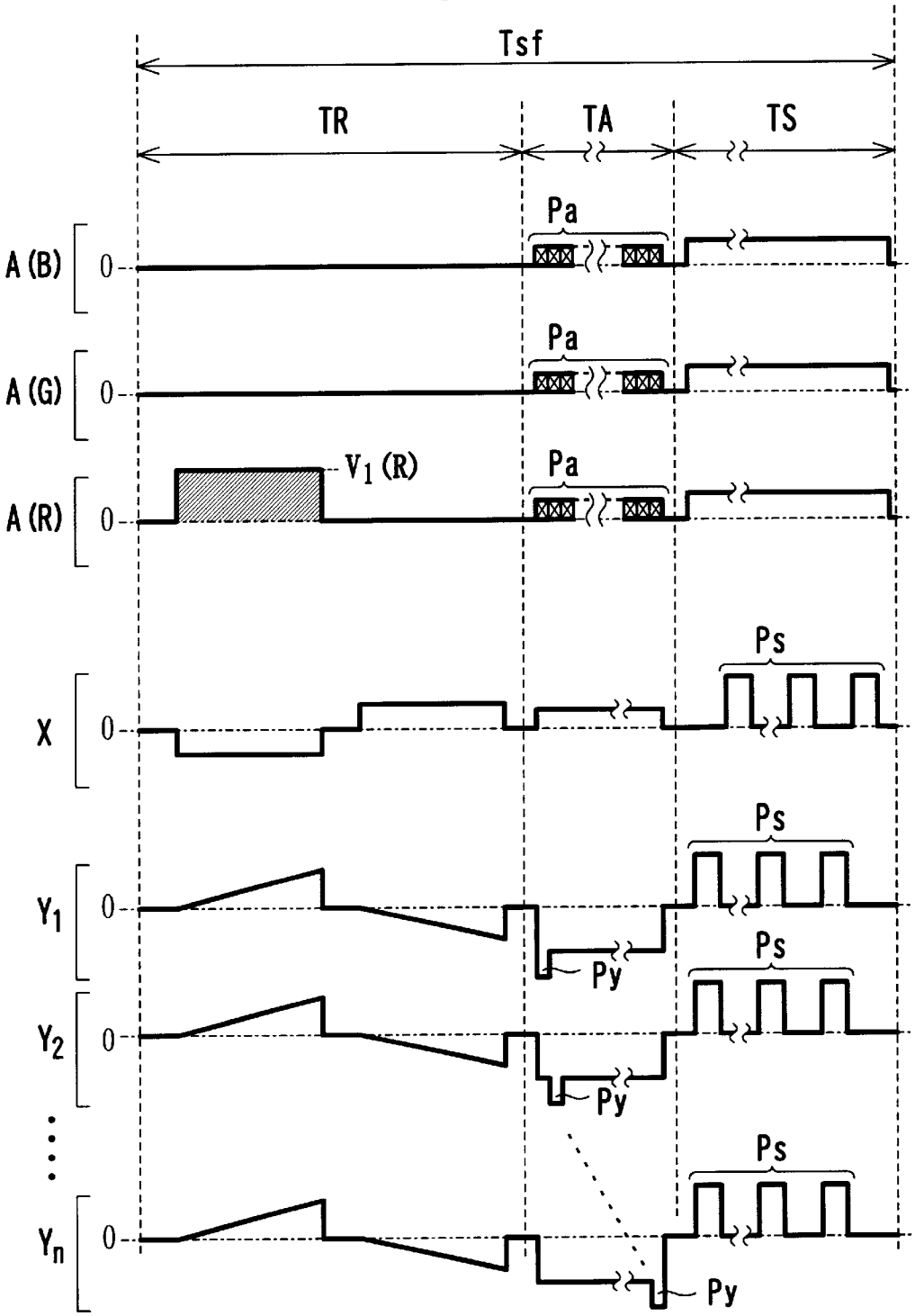
Figure 17:
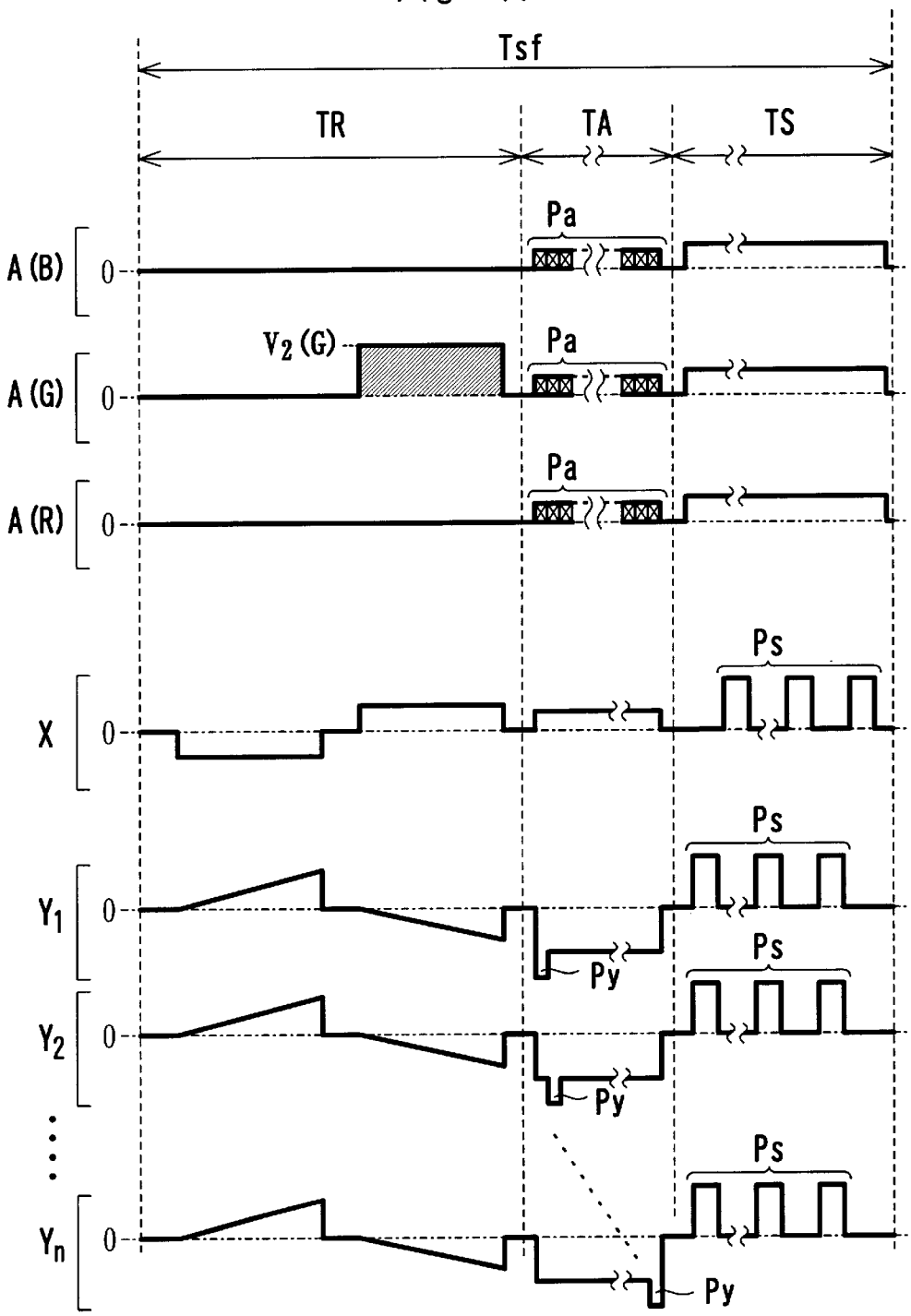

FIG. 16 shows a drive example in which the discharge characteristics are equal between the blue cell and the green cell. In FIG. 16, the write pulse is applied only to the address electrodes A corresponding to the red cells. FIG. 17 shows a drive example in which the discharge characteristics are equal between the blue cell and the red cell. In FIG. 17, the compensating discharge pulse is applied only to the address electrodes A corresponding to the green cells.

[Second Embodiment]

Figure 18:
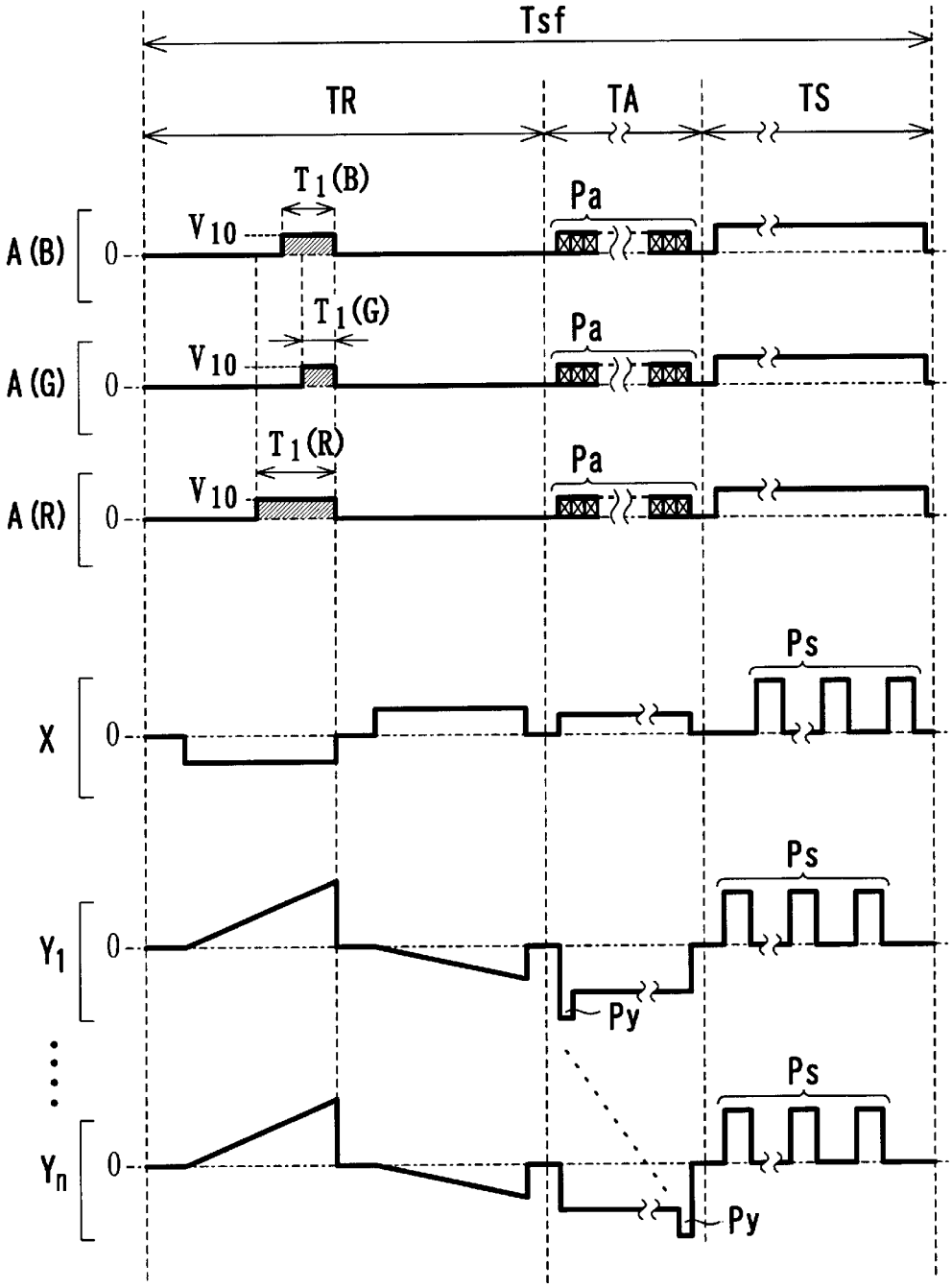
FIG. 18 is a diagram showing waveforms of applied voltage in a second embodiment.
Figure 19:
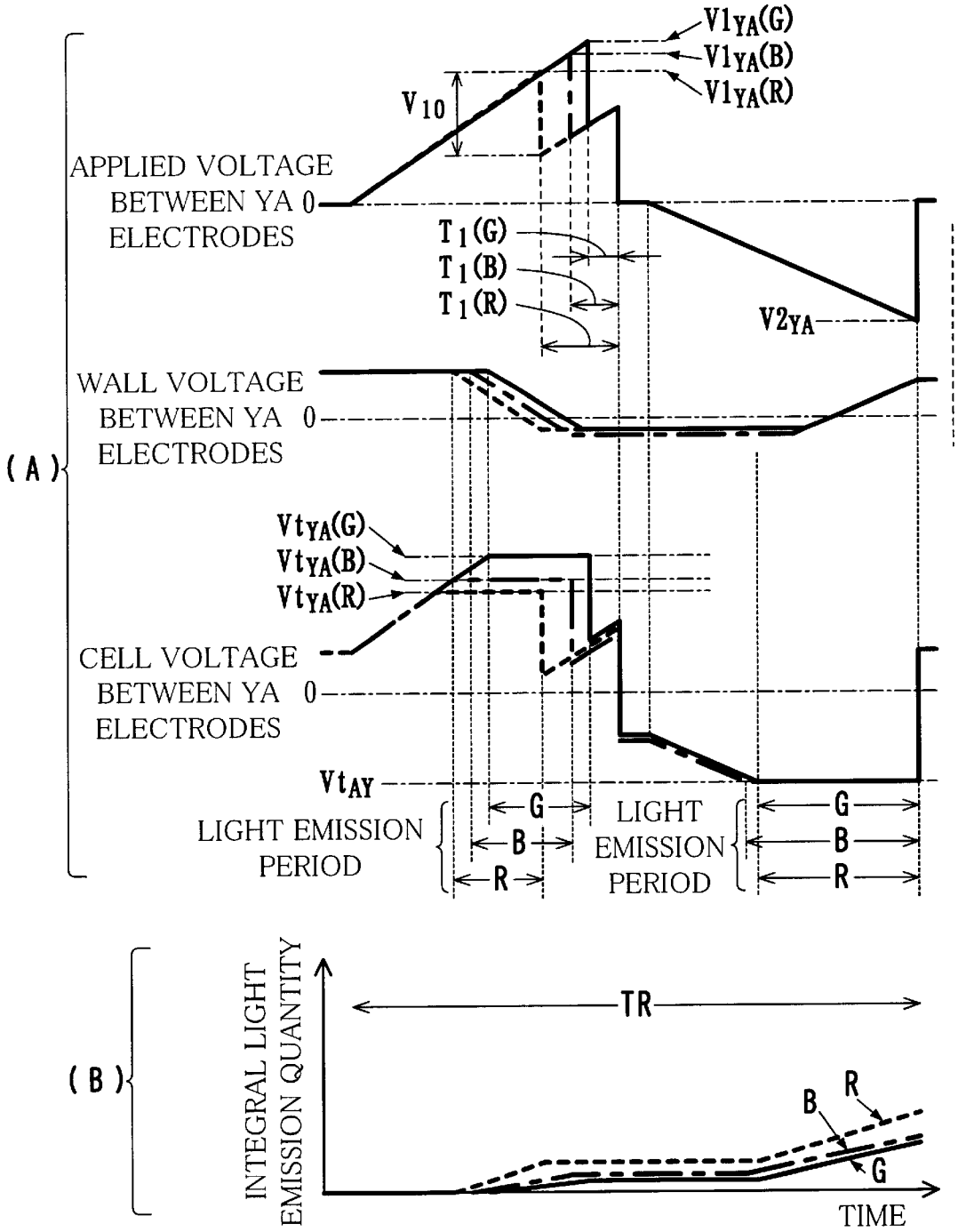
FIG. 19 is a diagram showing voltage waveforms and a transition of an integral light emission quantity in a reset process of the second embodiment.
Figure 20:
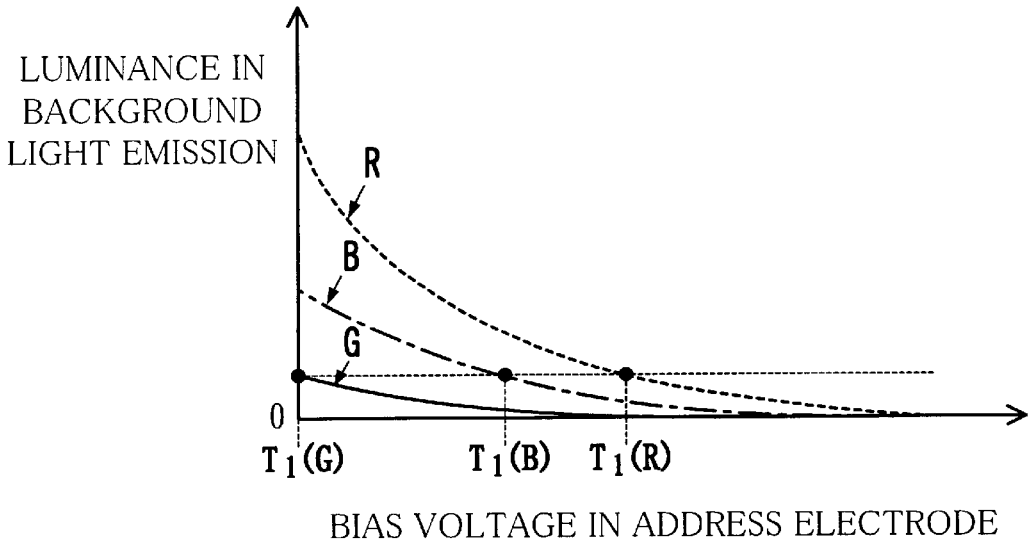
FIG. 20 is a graph showing a concept of voltage setting in the second embodiment.

FIG. 18 is a diagram showing waveforms of applied voltage in the second embodiment. FIG. 19 is a diagram showing voltage waveforms and a transition of an integral light emission quantity in a reset process of the second embodiment. FIG. 20 is a graph showing a concept of voltage setting in the second embodiment.

In the second embodiment, widths of pulses that are applied to the address electrode A in the reset period TR are set for each type (red, green or blue) of the fluorescent material. For example, if the relationship (1) is satisfied for discharge start threshold levels, the pulse widths $T_1(R)$, $T_1(G)$ and $T_1(B)$ of the write pulses are set so that the following relationship (4) is satisfied. The write pulse is set to a rectangular pulse, whose amplitude is set to a value $V_{10}$ that is common to all the address electrodes A regardless of the type of the fluorescent material.

$$T_1(G)<T_1(B)<T_1(R) \quad (4)$$

When applying the write pulse to the address electrode A, the timing is set so as to be identical to the falling edge of the write pulse of the ramp waveform that is applied to the display electrode Y. Thus, as shown in FIG. 19A, the longer the pulse widths $T_1(R)$, $T_1(G)$ and $T_1(B)$ are, the earlier the application of the ramp voltage between YA electrodes finishes.

By applying the ramp voltage, the micro discharge starts in the order of red, blue and green colors and finishes in the same order. Therefore, the periods in which light emission is generated by the application of the write pulse become equal among red, blue and green colors. In addition, the light emission periods become uniform also during the application of the compensating discharge pulse. Therefore, as shown in FIG. 19B, the integral light emission quantities of red and blue colors in the reset period TR become close to that of green color. Thus, the luminance of the background light emission is lowered as a whole. Even if the light emission period is not uniform in all cells, but if the difference is decreased, the effect of reducing the background light emission and improving contrast can be obtained. Noting the light emission characteristics shown in FIG. 20, the pulse width $T_1(R)$ and $T_1(B)$ of red and blue colors are set so that similar luminance to that of the green color having the lowest luminance can be obtained.

Though a rectangular wave of the positive polarity is used as the write pulse for the address electrode here, a rectangular wave pulse of the negative polarity or a ramp wave can be also used. In addition, it is possible to apply the compensating discharge pulse.

Figure 21:
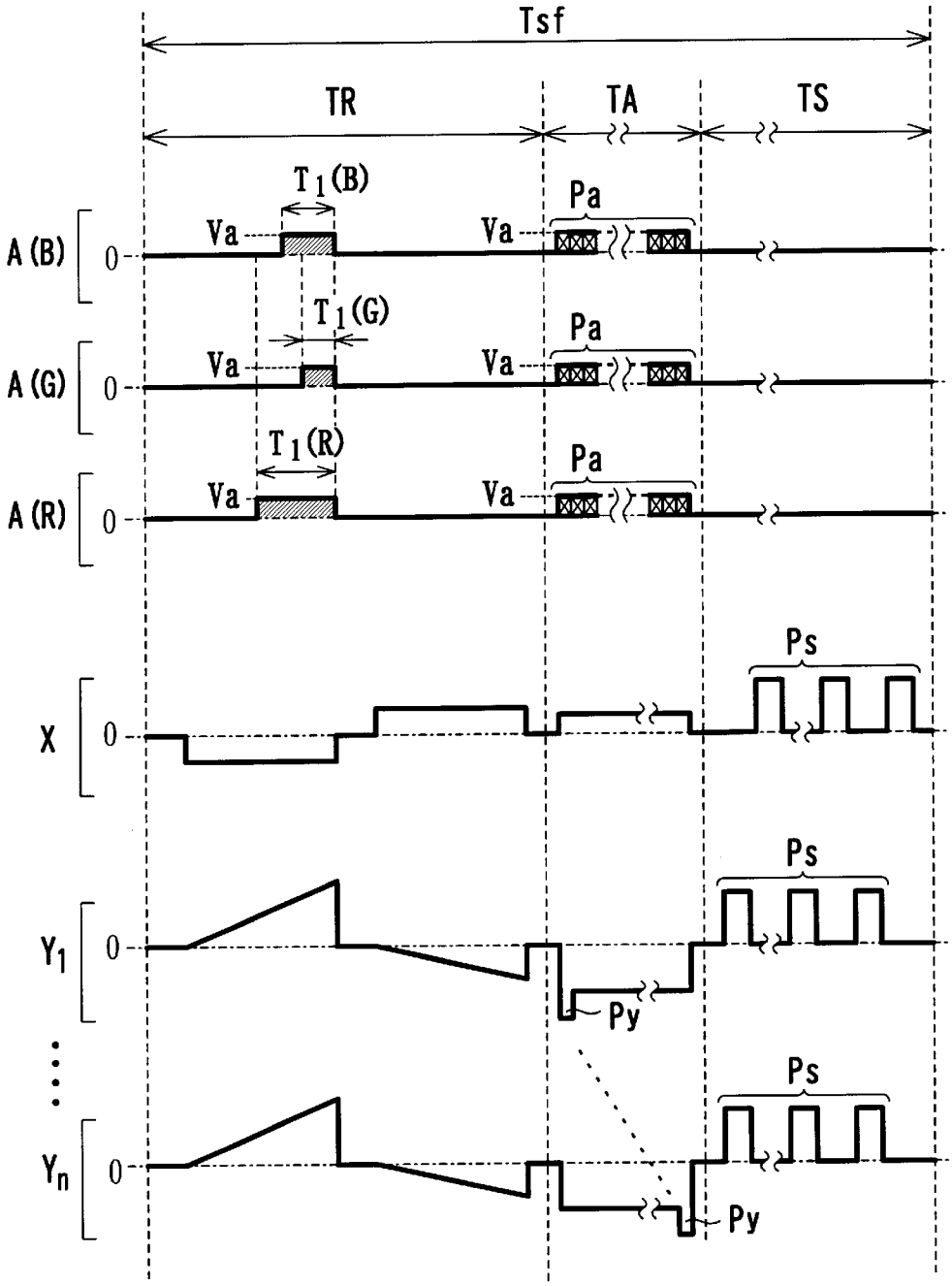
FIGS. 21–28 show waveforms of the applied voltages in other examples of the second embodiment.
Figure 22:
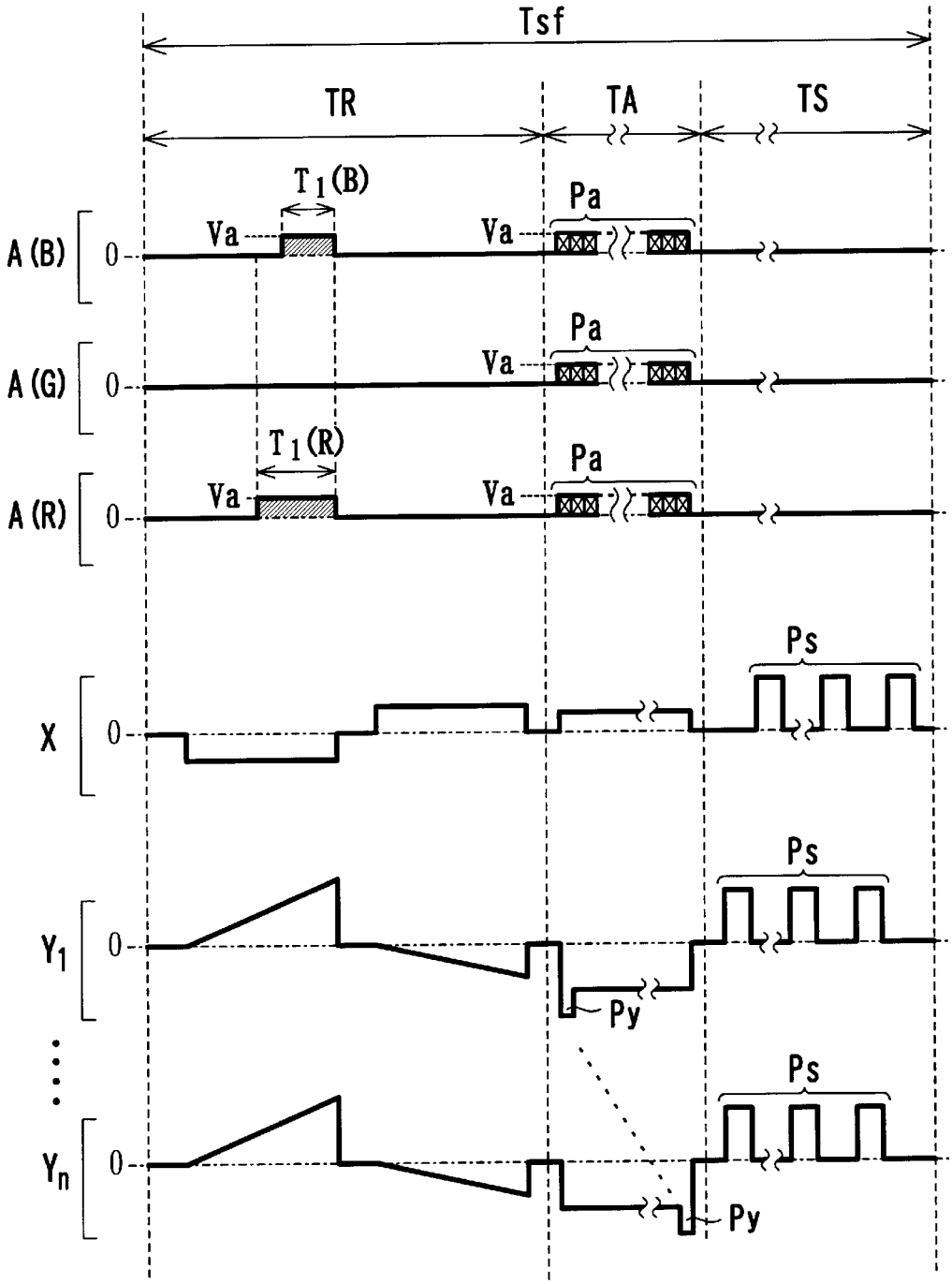

FIGS. 21–28 show waveforms of the applied voltages in other examples of the second embodiment. In FIG. 21, an amplitude Va of the write pulse that is applied to the address electrode A is set to the same value as the amplitude of the address pulse Pa. Thus, the number of power sources that are necessary for controlling potentials of the address electrodes A can be reduced. This is effective in reducing a cost of the drive unit 70. In FIG. 22, the pulse width of the write pulse corresponding to the green cell is zero.

Figure 23:
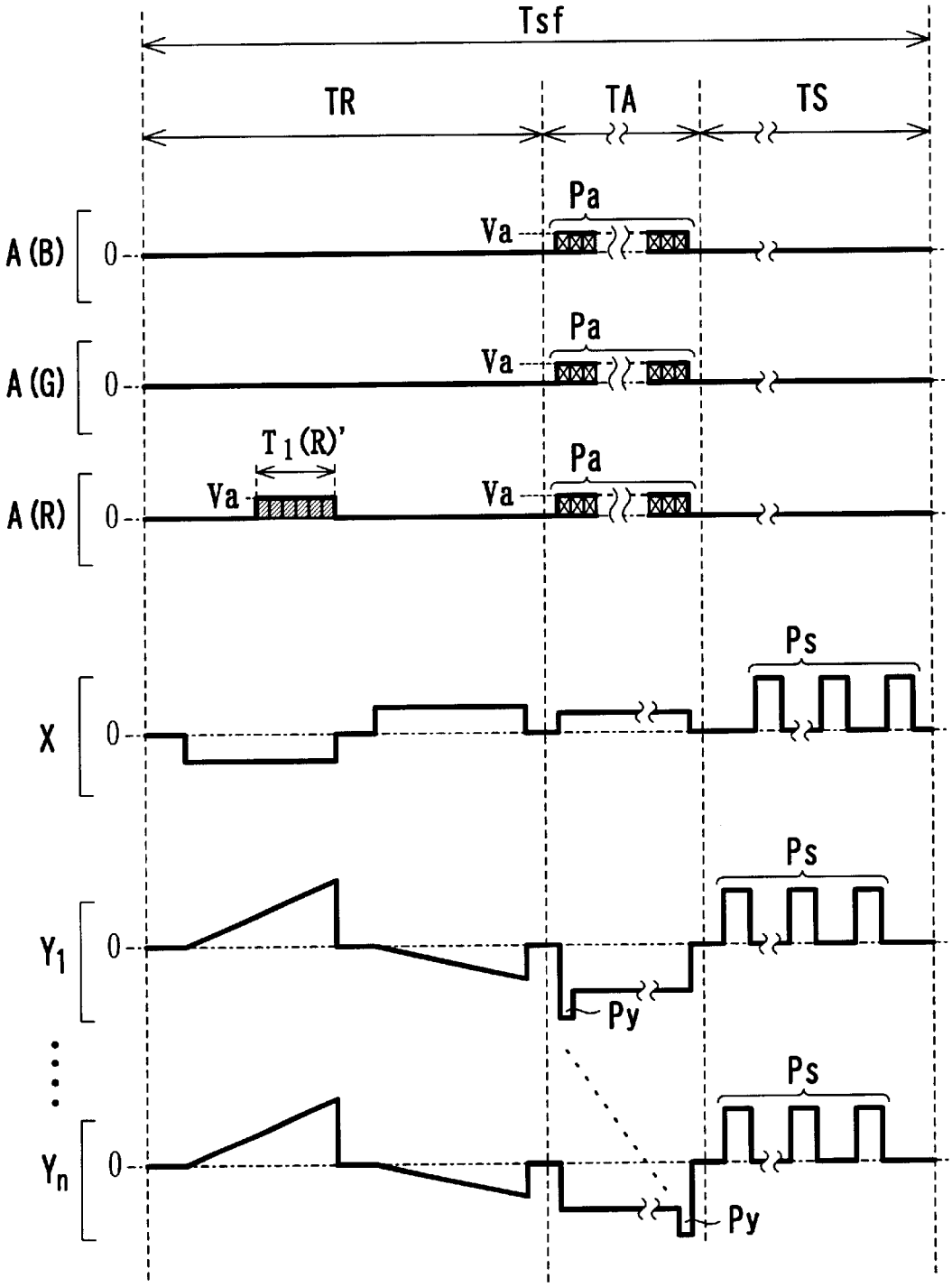

In FIG. 23, the write pulse is applied only to the address electrodes A corresponding to the red cells in the reset period TR. Then, the write pulse amplitude Va is set to the same value as the amplitude of the address pulse Pa, and the pulse width $T_1(R)'$ is set to an integral multiple of the pulse width (specifically the period) of the address pulse Pa. In other words, the write pulse corresponds to an address pulse Pa or plural address pulses Pa that are applied continuously. According to this example, the reset process can be performed by controlling the A-driver 88 in the same way as addressing, and the controller 71 and the A-driver 88 can be simplified.

Figure 24:
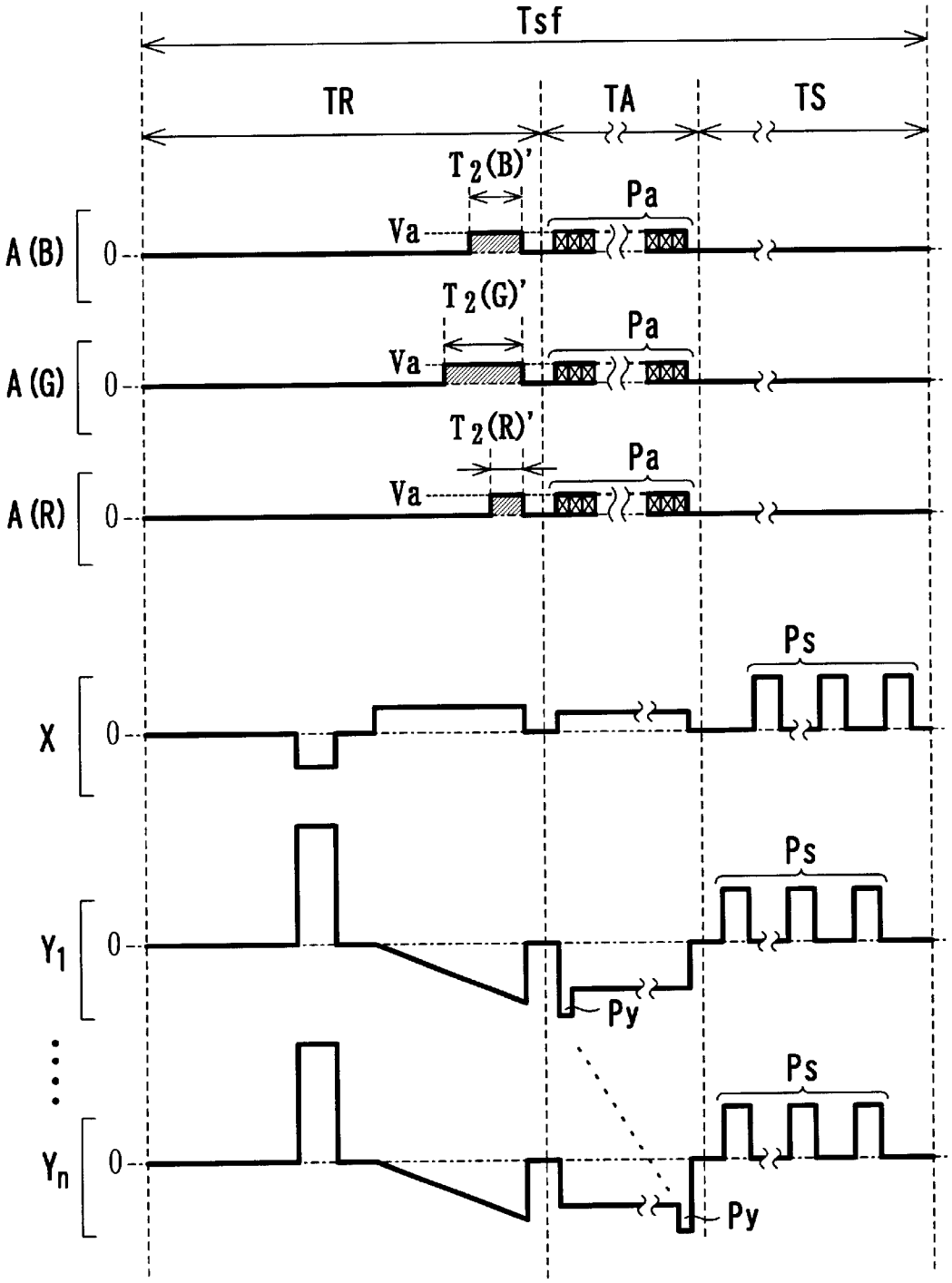

In FIG. 24, a rectangular waveform pulse is applied to the display electrode X and the display electrode Y as the write pulse in the reset period TR. The compensating discharge pulses having pulse widths $T_2(B)'$, $T_2(G)'$ and $T_2(R)'$ corresponding to the fluorescent material are applied to the address electrodes A.

Figure 25:
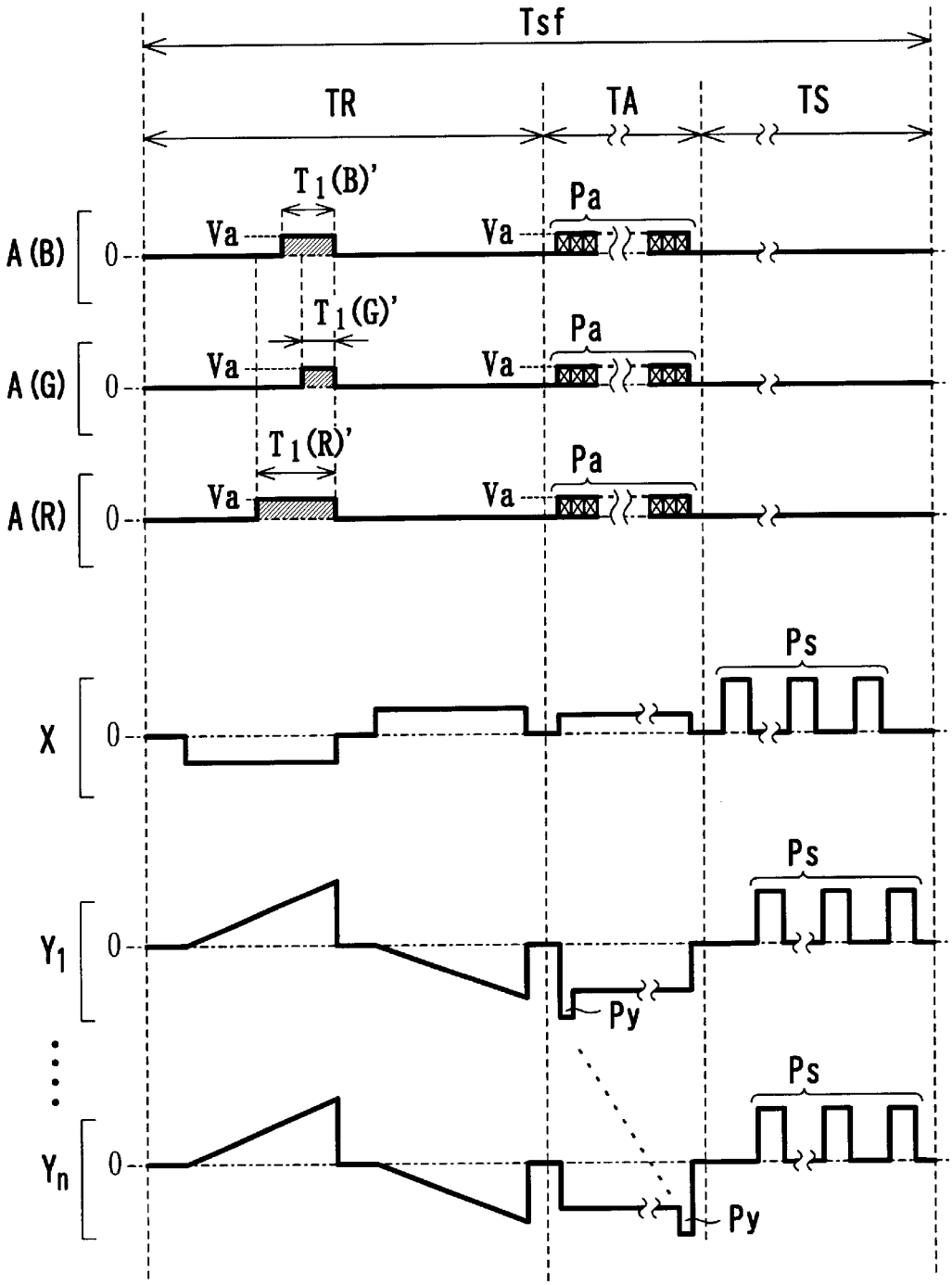

In FIG. 25, the addressing is performed in an erasing format. The wall charge suitable for sustaining is formed in the reset period TR, and the wall charge of the cell that is not lighted in the address period TA is erased. In the display period TS, the sustaining pulse Ps is applied to the display electrode X first. The pulse width of the write pulse that is applied to the address electrode A is set so as to satisfy the following relationship.

$$T_1(G)'<T_1(B)'<T_1(R)' \quad (5)$$

Figure 26:
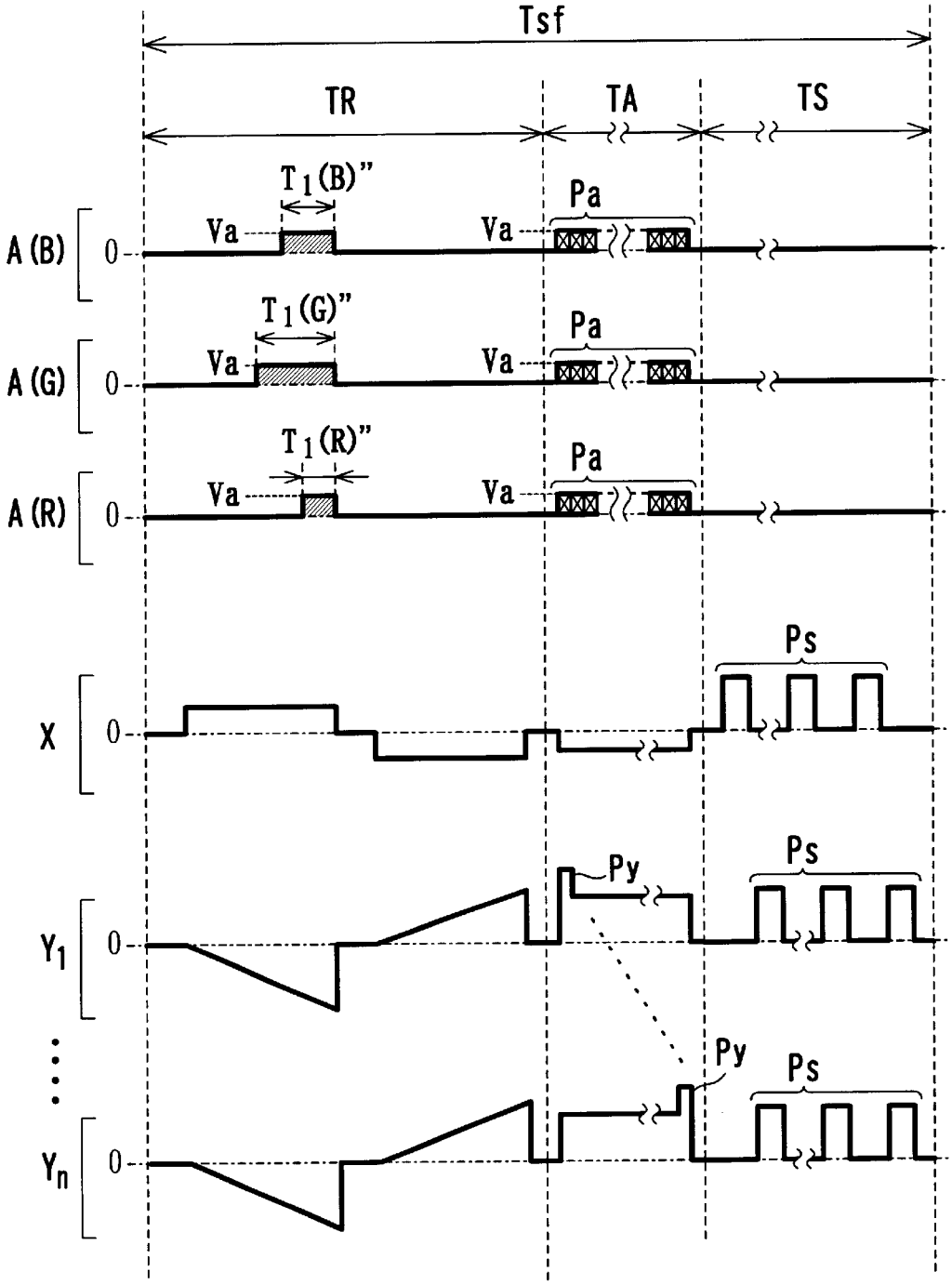

In FIG. 26, polarities of write pulses that are applied to the display electrodes X and Y and the address electrodes A are set so that the address electrode A becomes the anode in a discharge between YA electrodes generated by the write pulse. The pulse width of the write pulse that is applied to the address electrode A satisfies the following relationship.

$$T_1(R)''<T_1(B)''<T_1(G)'' \quad (6)$$

Figure 27:
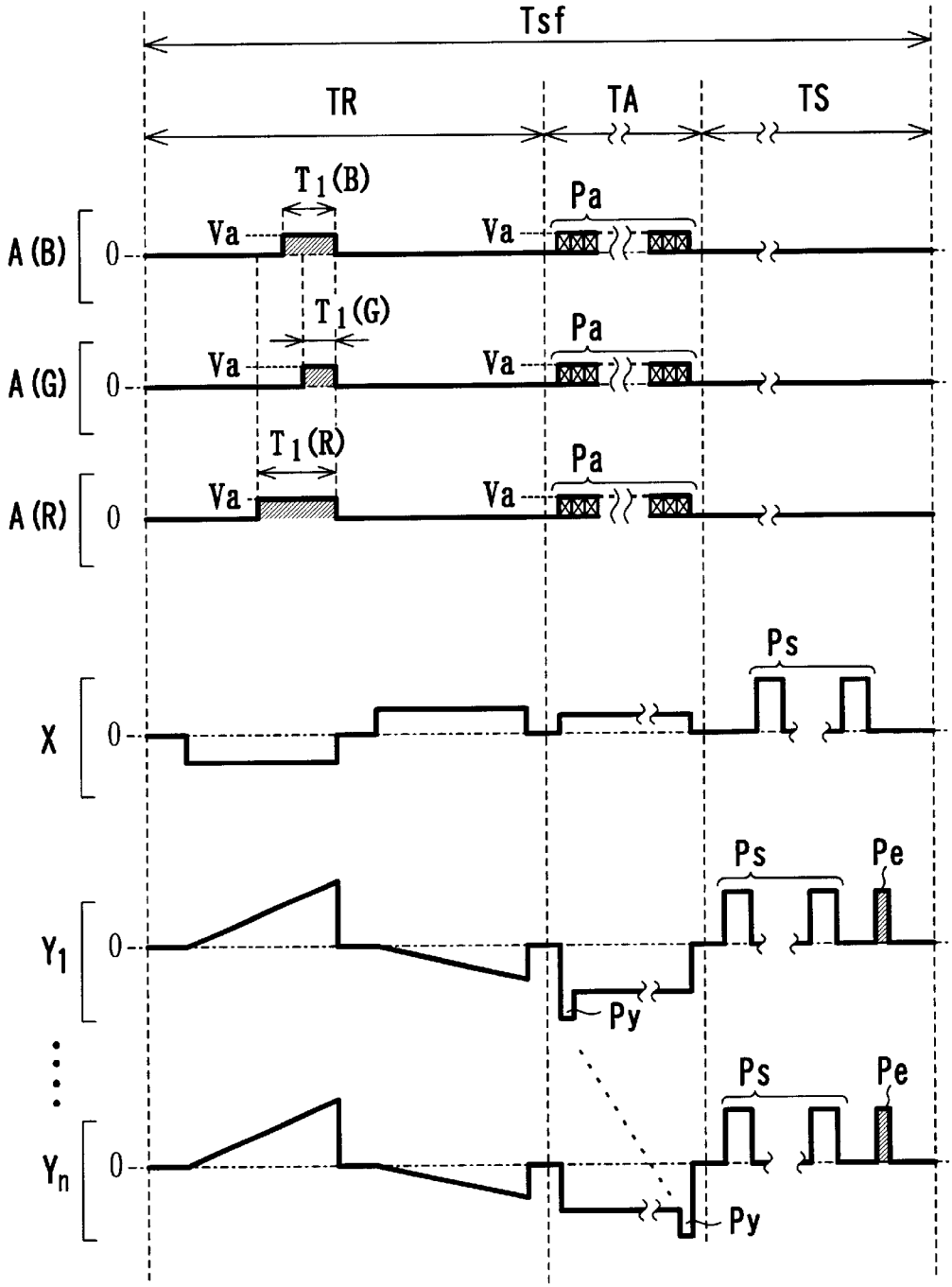
Figure 28:
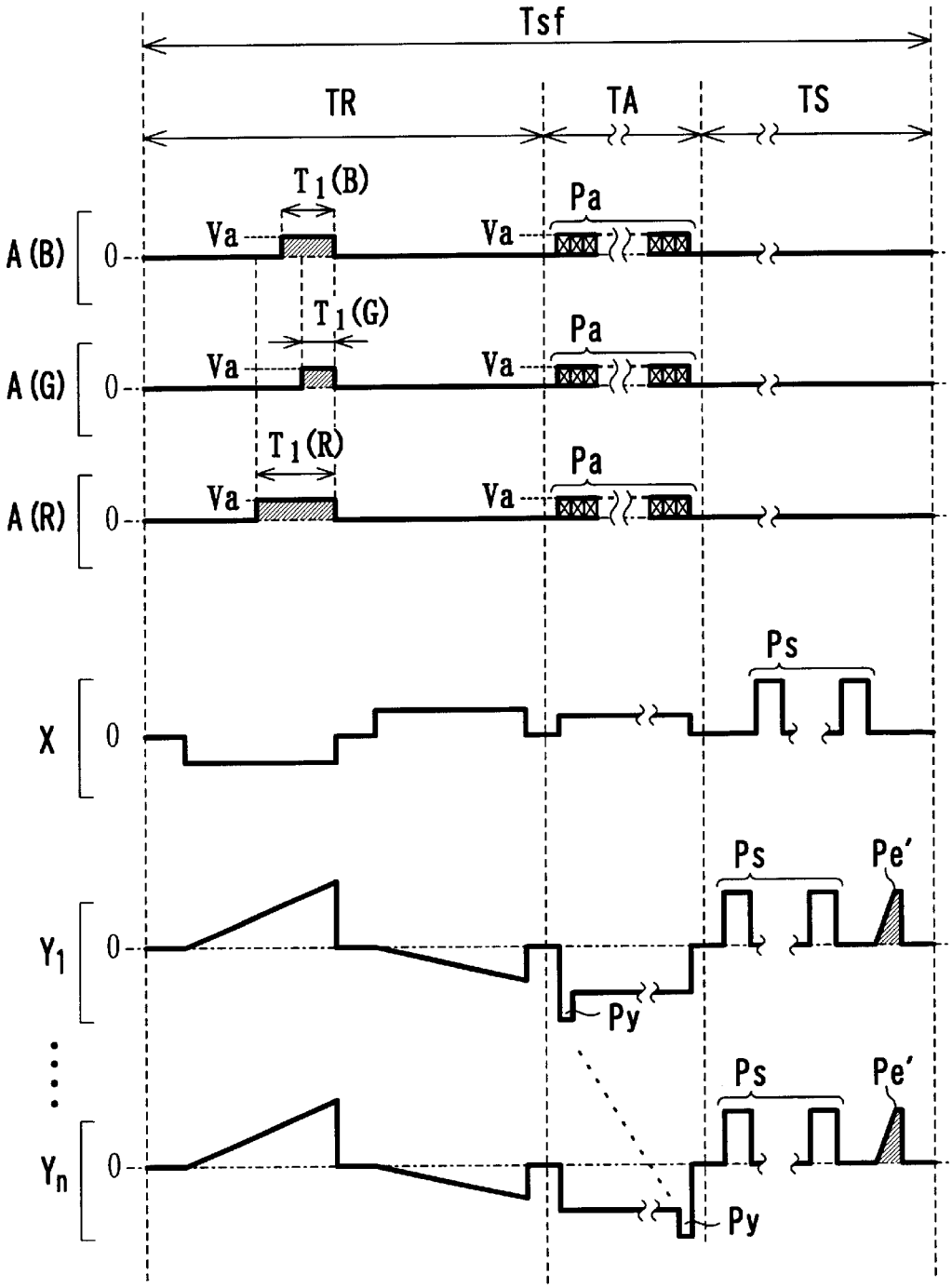

FIGS. 27 and 28 show examples in which erasing pulses Pe and Pe' are applied as the final pulse in the display period TS so as to erase the wall charge of the lighted cell. The erasing pulse Pe is a narrow pulse having a pulse width of approximately 500 ns. The erasing pulse Pe' is a steep ramp waveform pulse that causes a strong discharge like an impulse. The erasing pulse Pe' can be a steep obtuse wave pulse.

Applying the rectangular write pulse to the display electrodes X and Y, performing the erasing format addressing, setting the address electrode A as an anode, and applying the erasing pulse in the display period TS can be adapted to the first embodiment too.

[Third Embodiment]

Figure 29:
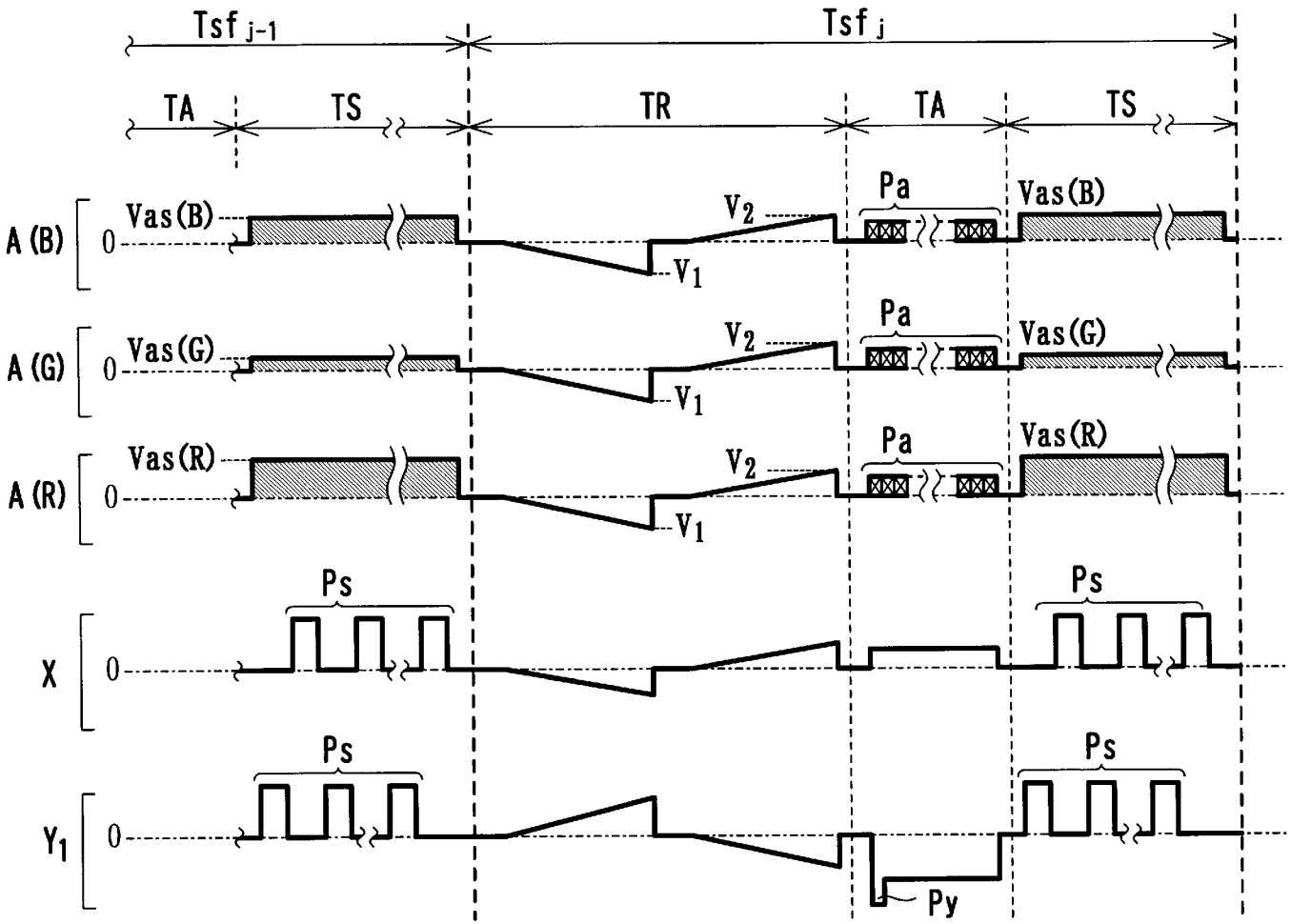
FIG. 29 is a diagram showing waveforms of applied voltage in a third embodiment.
Figure 30:
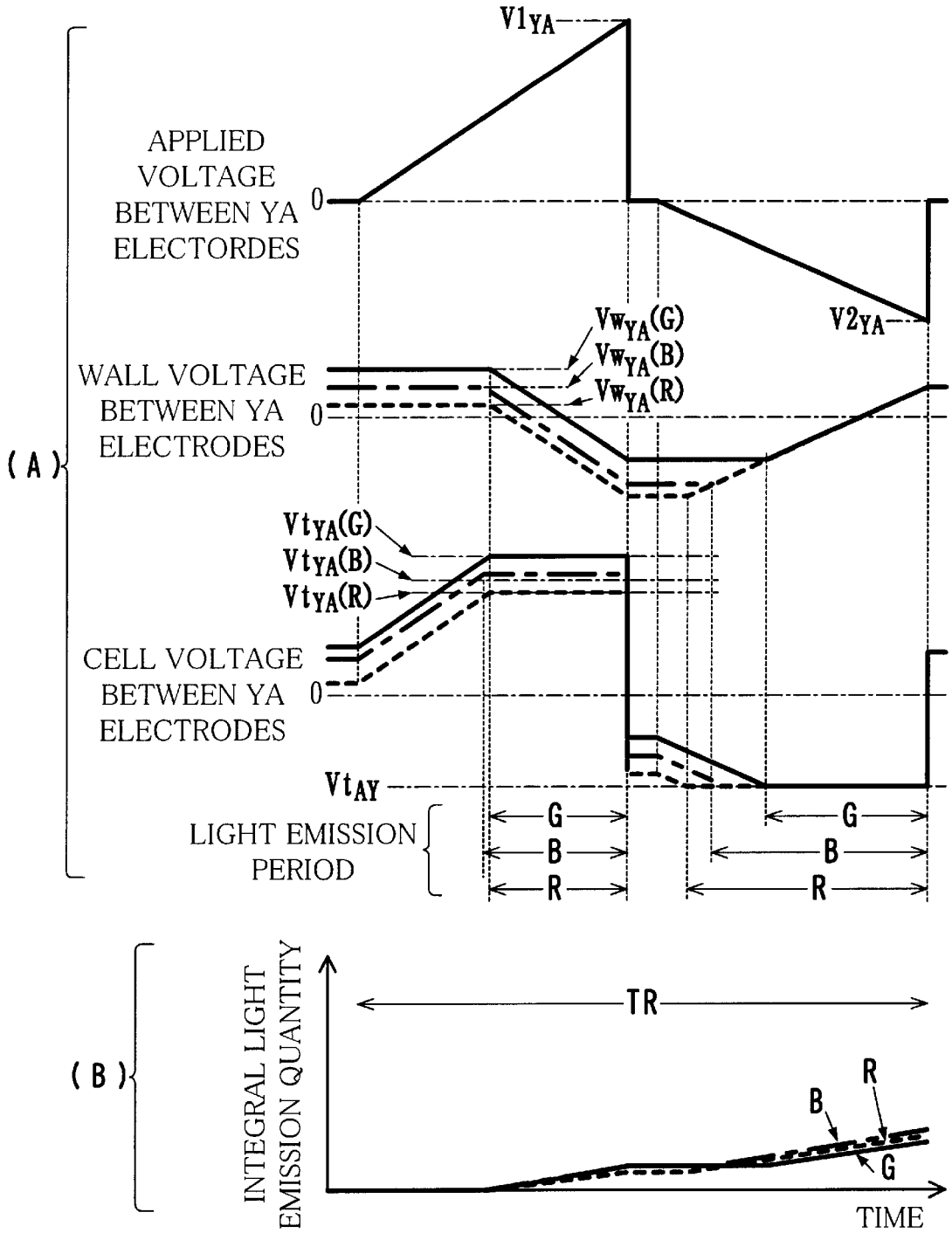
FIGS. 30A and 30B are diagrams showing voltage waveforms and a transition of an integral light emission quantity in a reset process of the third embodiment.
Figure 31:
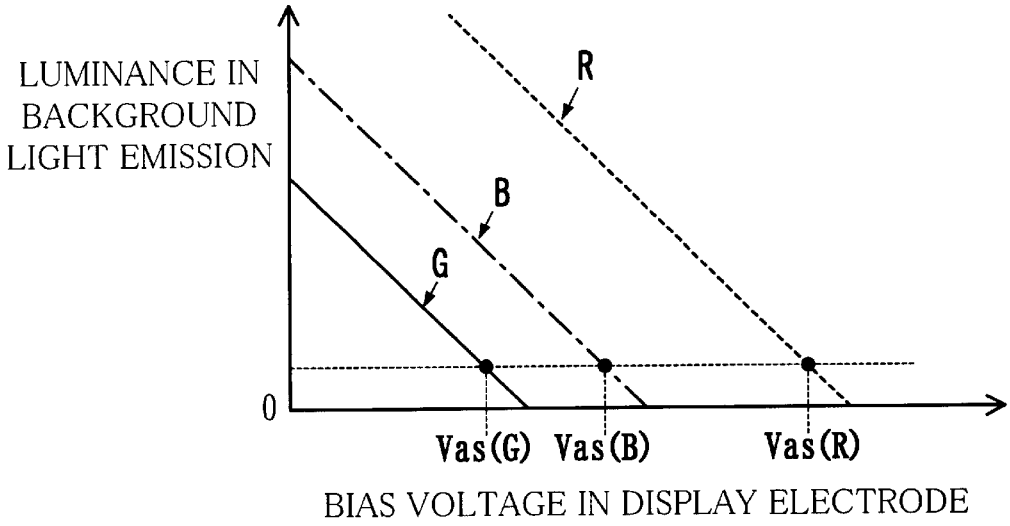
FIG. 31 is a graph showing a concept of voltage setting in the third embodiment.

FIG. 29 is a diagram showing waveforms of applied voltage in the third embodiment. FIGS. 30A and 30B are diagrams showing voltage waveforms and a transition of an integral light emission quantity in a reset process of the third embodiment. FIG. 31 is a graph showing a concept of voltage setting in the third embodiment.

In the third embodiment, a bias potential of the address electrode A in the display period TS is set for each type (red, green or blue) of the fluorescent material, so that the background light emission in the reset period TR of the next subframe can be reduced.

In the display period TS, a wall voltage having an opposite polarity to the previous one is generated between XY electrodes of the lighted cell at every display discharge. If the bias potential Vas of the address electrode A is set to a medium potential corresponding to an approximately half amplitude of the sustaining pulse Pa, the wall charge is hardly generated on the address electrode A. If the bias potential Vas is set to a lower value than the medium potential, a relatively positive wall charge is accumulated on the address electrode A. On the contrary, if the bias potential Vas is set to a higher value than the medium potential, a relatively negative wall charge is accumulated on the address electrode A. Thus, as for a lighted cell, the wall voltage between YA electrodes at the start point of the reset process can be controlled by setting the bias potential Vas of the address electrode A in the display period TS.

When the bias potentials of red, green and blue colors are denoted as Vas(R), Vas(B) and Vas(G), respectively, the potentials are set to satisfy the following relationship under the condition of the relationship (1).

$$Vas(G)<Vas(B)<Vas(R) \quad (7)$$

In this case of setting, the wall voltages $Vw_{YA}(R)$, $Vw_{YA}(B)$ and $Vw_{YA}(G)$ between YA electrodes at the start point of the reset process are different depending on the type of the fluorescent material as shown in FIG. 30A. Since the micro discharge starts at substantially the same time by applying the write pulse, the period in which the light emission is generated by the application of the write pulse becomes equal among red, blue and green colors. Therefore, as shown in FIG. 30B, the integral light emission quantity of red and blue colors in the reset period TR become close to that of green color, and the luminance of the background light emission is lowered as a whole. The third embodiment is effective especially in the case where the ratio of the lighted cells is large.

Figure 32:
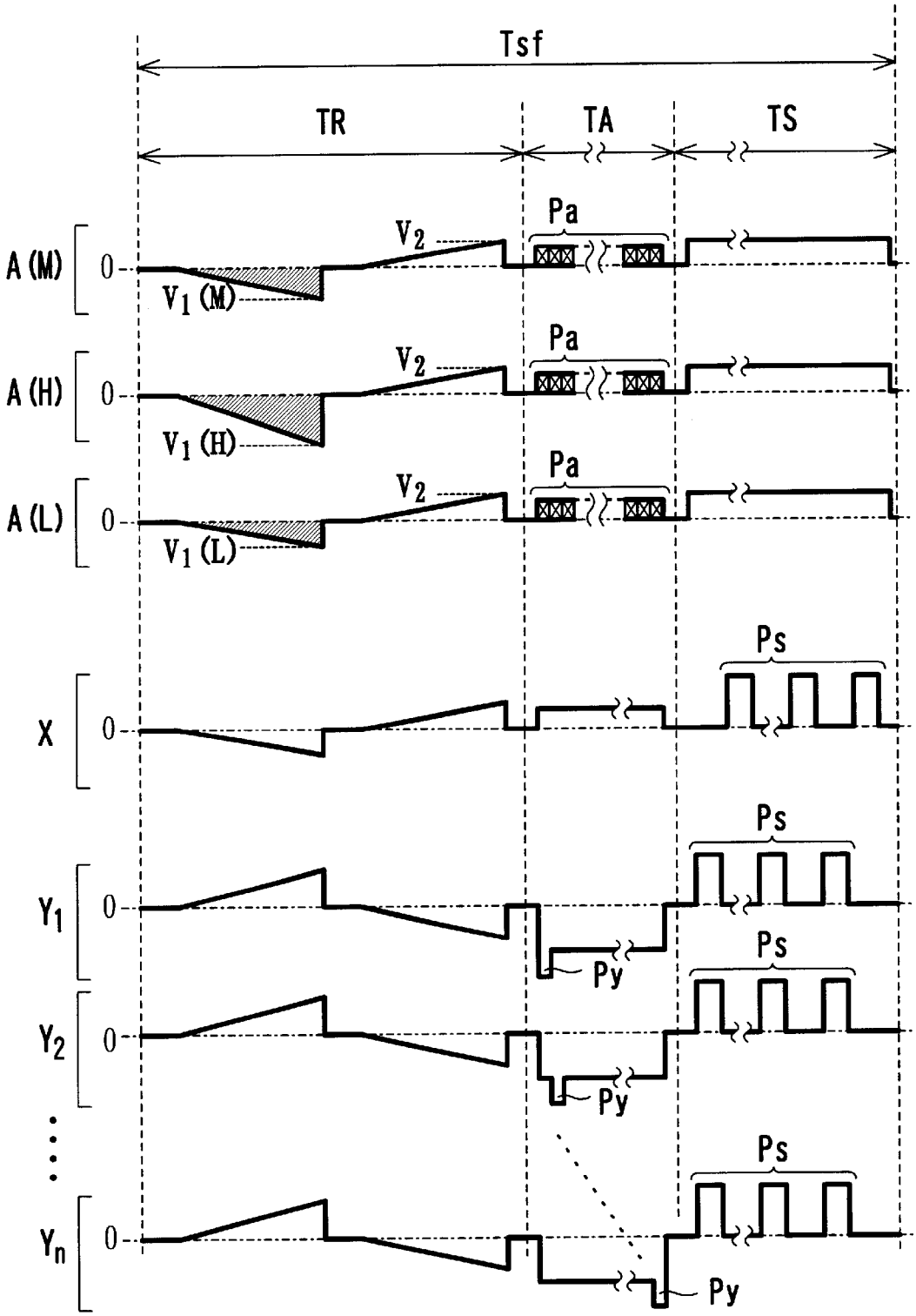
FIG. 32 shows waveforms of the applied voltages in other examples of grouping of address electrodes.

In the above-mentioned three embodiments, examples of grouping the address electrodes A in accordance with the corresponding type of fluorescent material are explained. However, the grouping is not limited to the above examples. In the case where the quantity difference of the filled fluorescent material causes the difference of discharge characteristics, for example, discharge characteristics are faithful to design in almost of all columns, and discharge characteristics of only some columns are exceptional. In this case, the columns faithful to design are separated from the exceptional columns in the grouping. In FIG. 32, address electrodes A(M) corresponding to the columns having a discharge start threshold level faithful to design, address electrodes A(H) corresponding to the columns having a high discharge start threshold level, and address electrodes A(L) corresponding to the columns having a low discharge start threshold level are supplied with ramp waveform pulses as write pulses having amplitudes $V_1(M)$, $V_1(H)$ and $V_1(L)$ suitable for each of them.

Figure 33:
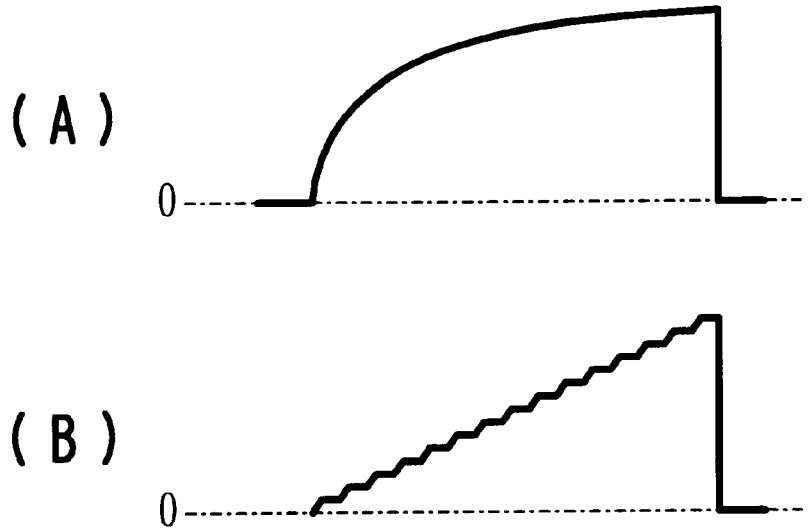
FIG. 33 shows waveforms of an increasing voltage waveform in other examples.
Figure 34:
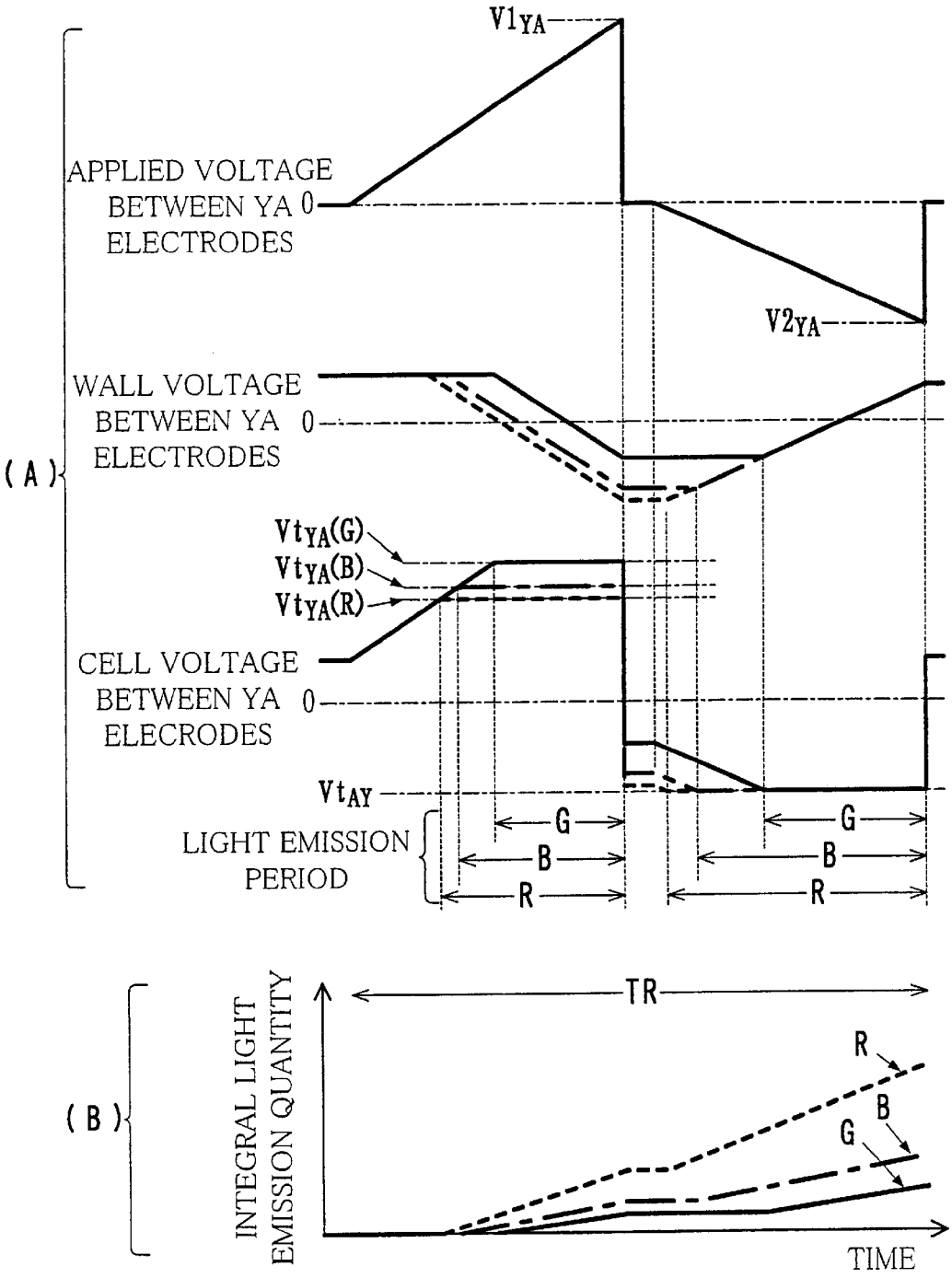
Fig. 34 PRIOR ART
FIGS. 34A and 34B are diagrams showing voltage waveforms and a transition of an integral light emission quantity in the conventional reset process.

In the above-mentioned embodiments, the ramp waveform voltage can be replaced with an increasing voltage such as an obtuse waveform voltage or a step waveform voltage shown in FIG. 33. The amplitude control, the pulse width control and the bias potential control can be combined so as to improve the reset process. The addressing can be performed in the format of distinguishing between lighted and non-lighted by the presence or absence of the wall charge. Otherwise, it can be a priming address format in which the lighted and non-lighted is controlled by intensity of the address discharge.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A driving method of a plasma display panel, comprising:

resetting to equalize wall charge in cells of a screen;

addressing to control potentials of address electrodes crossing display electrodes in accordance with display data; and sustaining to apply a sustaining voltage to the cells to generate display discharges, wherein the address electrodes are grouped in accordance with discharge characteristics of cells corresponding to each address electrode, and said resetting comprises applying an increasing voltage between the display electrodes and the address electrodes and controlling the potential of the address electrodes that is unique to each group, the luminance of the discharge light emission in the reset becoming uniform among cells having different discharge characteristics.

2. The driving method according to claim 1, wherein the plasma display panel comprises two substrates facing each other and sandwiching a discharge space, the display electrodes being arranged on one of the substrates, and the address electrodes and a plurality of different types of florescent materials being arranged on the other substrate, and the address electrodes being grouped in accordance with the type of the fluorescent material arranged on the cells corresponding to each address electrode.

3. The driving method according to claim 1, wherein said resetting comprises applying voltage pulses having different amplitudes for each group to the address electrodes.

4. A driving method of a plasma display panel, comprising:

resetting to equalize wall charge in cells of a screen;

addressing to control potentials of address electrodes in accordance with display data; and sustaining to apply a sustaining voltage to the cells to generate display discharges, wherein the address electrodes are grouped in accordance with disgrace characteristics of cells corresponding to each address electrode, said resetting comprising applying an increasing voltage between the display electrodes and the address electrodes, and said sustaining comprising controlling the potential of the address electrodes that is unique to each group, the luminance of the discharge light emission in the reset that is performed after said sustaining becoming uniform among cells having different discharge characteristics.

5. The driving method according to claim 4, wherein the plasma display panel comprises two substrates facing each other and sandwiching a discharge space, the display electrodes being arranged on one of the substrates, and the address electrodes and a plurality of different types of florescent materials being arranged on the other substrate, and the address electrodes being grouped in accordance with the type of the fluorescent material arranged on the cells corresponding to each address electrode.

6. The driving method according to claim 4, wherein said resetting comprises applying voltage pulses having different amplitudes unique to each group to the address electrodes.

7. The driving method according to claim 4, wherein said sustaining comprises biasing the address electrodes to different potentials unique to each group.

8. The driving method according to claim 1, wherein said resetting comprises applying voltage pulses having different pulse widths unique to each group to the address electrodes.

9. The driving method according to claim 8, wherein an amplitude of the voltage pulses is equal to the amplitude of the address pulse that is applied to the address electrodes during said addressing.

10. The driving method according to claim 9, wherein said resetting comprises applying a pulse having the same amplitude and pulse width as those of the address pulse to the address electrodes plural times unique to each group.

11. A display device comprising:

a plasma display panel having two substrates facing each other and sandwiching a discharge space, display electrodes arranged on one of the substrates, and address electrodes crossing the display electrodes and a plurality of different types of fluorescent materials arranged on the other substrate, the address electrodes being grouped in accordance with discharge characteristics of cells of a screen that correspond to each address electrode; and a driving circuit applying an increasing voltage between the display electrodes and the address electrodes during a resetting operation to equalize wall charge in the cells of the screen, to perform potential control of the address electrodes that is unique to each group in accordance with the discharge characteristics of the cells corresponding to each address electrode, with the luminance of the discharge light emission becoming uniform among cells having different discharge characteristics in the reset.

12. The display device according to claim 11, wherein the driving circuit applies voltage pulses having different pulse widths unique to each group to the address electrodes in the reset, and an amplitude of the voltage pulse is equal to an amplitude of an address pulse that is applied to the address electrodes during an addressing operation.

13. The display device according to claim 12, wherein the driving circuit applies a voltage pulse having the same amplitude and pulse width as those of the address pulse to the address electrodes plural times unique to each group in the reset.

* * * * *